US009855670B2

(12) United States Patent
Johnston et al.

(10) Patent No.: US 9,855,670 B2
(45) Date of Patent: Jan. 2, 2018

(54) ADJUSTABLE PUNCH ASSEMBLIES AND ASSOCIATED ADJUSTMENT METHODS

(71) Applicant: Wilson Tool International Inc., White Bear Lake, MN (US)

(72) Inventors: Kevin A. Johnston, Deer Park, WI (US); Gordon A. Straka, Afton, MN (US)

(73) Assignee: WILSON TOOL INTERNATIONAL INC., White Bear Lake, MN (US)

( * ) Notice: Subject to any disclaimer, the term of this patent is extended or adjusted under 35 U.S.C. 154(b) by 315 days.

(21) Appl. No.: 13/854,626

(22) Filed: Apr. 1, 2013

(65) Prior Publication Data

US 2013/0319200 A1 Dec. 5, 2013

Related U.S. Application Data

(63) Continuation of application No. 12/266,324, filed on Nov. 6, 2008, now Pat. No. 8,408,111.

(51) Int. Cl.

| | |
|---|---|
| ***B26F 1/14*** | (2006.01) |
| ***B21D 28/34*** | (2006.01) |
| ***B21D 45/00*** | (2006.01) |

(52) U.S. Cl.

CPC ..... *B26F 1/14* (2013.01); *B21D 28/34* (2013.01); *B21D 28/346* (2013.01); (Continued)

(58) Field of Classification Search

CPC .... B21D 28/34; B21D 28/346; B21D 45/006; B26F 1/14; Y10T 83/04; Y10T 83/929; Y10T 83/9476; Y10T 83/9486

See application file for complete search history.

(56) References Cited

U.S. PATENT DOCUMENTS

| | | | |
|---|---|---|---|
| 1,383,414 | A | 7/1921 | Mansell |
| 1,386,259 | A | 8/1921 | Jourdan et al. |

(Continued)

FOREIGN PATENT DOCUMENTS

| | | |
|---|---|---|
| BE | 1014961 | 7/2004 |
| CN | 1524020 A | 8/2004 |

(Continued)

OTHER PUBLICATIONS

PCT/US2009/063062, Written Opinion and International Search Report dated Feb. 17, 2010, 15 pages.

*Primary Examiner* — Stephen Choi
(74) *Attorney, Agent, or Firm* — Fredrikson & Byron, P.A.

(57) ABSTRACT

A punch tool assembly includes an adjustment subassembly coupled to a canister sidewall of the assembly. The adjustment subassembly includes a punch head, which engages a punch holder, or body, of the punch tool, at a threaded interface, so that rotation of the punch head moves the punch body/holder along a central longitudinal axis of the punch tool assembly. The adjustment subassembly further includes a locking member, which is biased with respect to the punch head, in a first position, where the locking member is engaged with a locking feature of an engagement sidewall of the subassembly, to lock the punch head and prevent rotation thereof. The locking member may be released, to unlock the punch head, by applying a force to an externally accessible actuation interface of a release member of the subassembly, for example, to rotate the actuation interface about the central longitudinal axis.

29 Claims, 22 Drawing Sheets

(52) U.S. Cl.
CPC ..... *B21D 45/006* (2013.01); *Y10T 83/04* (2015.04); *Y10T 83/929* (2015.04); *Y10T 83/9428* (2015.04); *Y10T 83/9476* (2015.04); *Y10T 83/9486* (2015.04)

(56) References Cited

U.S. PATENT DOCUMENTS

| | | | |
|---|---|---|---|
| 5,020,407 | A | 6/1991 | Brinlee |
| 5,131,303 | A | 7/1992 | Wilson et al. |
| 5,329,835 | A | 7/1994 | Timp et al. |
| 5,647,256 | A | 7/1997 | Schneider |
| 5,752,424 | A | 5/1998 | Rosene et al. |
| 5,832,798 | A | 11/1998 | Schneider et al. |
| 5,839,341 | A | 11/1998 | Johnson et al. |
| 5,884,546 | A | 3/1999 | Johnson |
| 6,047,621 | A | 4/2000 | Dries et al. |
| 6,082,516 | A | 7/2000 | Wilier |
| 6,142,052 | A | 11/2000 | Endo |
| 6,276,247 | B1 | 8/2001 | Helda |
| 6,334,381 | B1 | 1/2002 | Chatham |
| 6,782,787 | B2 | 8/2004 | Morehead et al. |
| 6,895,797 | B2 | 5/2005 | Lowry et al. |
| 7,156,009 | B2 | 1/2007 | Iwamoto et al. |
| 7,168,356 | B2 | 1/2007 | Rosene et al. |
| 7,658,134 | B2 | 2/2010 | Morgan |
| 8,408,111 | B2 | 4/2013 | Johnston et al. |
| 2004/0206223 | A1 | 10/2004 | Rosene et al. |
| 2006/0081107 | A1 | 4/2006 | Iwamoto et al. |
| 2007/0034069 | A1 | 2/2007 | Endo |
| 2007/0068352 | A1 | 3/2007 | Morgan |
| 2009/0266209 | A1* | 10/2009 | Thielges et al. ..... 83/140 |
| 2010/0107846 | A1 | 5/2010 | Lee |

FOREIGN PATENT DOCUMENTS

| | | | |
|---|---|---|---|
| CN | 101060947 | A | 10/2007 |
| DE | 19508091 | | 4/1996 |
| DE | 102006005572 | | 6/2007 |
| EP | 2373442 | A1 | 10/2011 |
| JP | H10-244331 | A | 9/1998 |
| JP | H10244327 | A | 9/1998 |
| JP | 2002282962 | | 10/2002 |
| JP | 2006110605 | A | 4/2006 |
| JP | 2006150392 | A | 6/2006 |
| JP | 2007160384 | A | 6/2007 |
| JP | 2008183576 | A | 8/2008 |

* cited by examiner

ADJUSTABLE PUNCH ASSEMBLIES AND ASSOCIATED ADJUSTMENT METHODS

CROSS-REFERENCE TO RELATED APPLICATION

The present application is a continuation of U.S. patent application Ser. No. 12/266,324, filed Nov. 6, 2008, now U.S. Pat. No. 8,408,111, and entitled ADJUSTABLE PUNCH ASSEMBLIES AND ASSOCIATED ADJUSTMENT METHODS, the disclosure of which is hereby incorporated, by reference, in its entirety and relates to commonly assigned U.S. patent application Ser. No. 12/266,341, filed Nov. 6, 2008, now U.S. Pat. No. 8,327,745, and entitled PUNCH ASSEMBLIES AND METHODS FOR MODIFYING.

TECHNICAL FIELD

The present invention pertains to punch assemblies and more particularly to configurations thereof that facilitate methods for adjusting the assemblies.

BACKGROUND

Punch presses are typically configured to hold a plurality of tools for forming a variety of shapes and sizes of indentations and/or holes in sheet workpieces, for example, sheet metal. Tools of this sort commonly include at least one punch assembly and corresponding die. In a multiple station turret punch press, a rotatable turret includes a plurality of bores, which hold a corresponding plurality of punch assemblies above a workpiece support surface, and a corresponding plurality of die receiving frames are located below the workpiece support surface.

A conventional punch assembly includes a punch guide, a punch body and a punch tip, which may be either fixedly or releasably attached to the body. The punch body and tip are slidably engaged within the punch guide for reciprocal, axial movement along a central longitudinal axis of the punch guide. When such a punch assembly, and a corresponding die, are mounted in a press and located in a working position of the press, beneath the ram (or integrally connected to the ram), the punch tip is driven out from the punch guide, through an opening in a stripper plate, in order to form an indentation or a hole through a sheet workpiece. The stripper plate, which is attached to an end of the punch guide, prevents the workpiece from following the punch tip, upon retraction back into the punch guide.

Those skilled in the art appreciate that punch assemblies require regular maintenance and adjustment, for example, to sharpen worn punch tips, to replace worn punch tips, to replace punch tips of one shape, or footprint, with those of an alternate shape, and/or to adjust a position of the punch body, and corresponding punch tip, within the assembly to account for different lengths thereof. Although a variety of punch assembly configurations, which facilitate these types of adjustments, have been disclosed, there is still a need for new punch assembly configurations and methods that increase the ease and the speed by which these adjustments can be made.

BRIEF DESCRIPTION OF THE DRAWINGS

The following drawings are illustrative of particular embodiments of the present invention and therefore do not limit the scope of the invention. The drawings are not to scale (unless so stated) and are intended for use in conjunction with the explanations in the following detailed description. Embodiments of the present invention will hereinafter be described in conjunction with the appended drawings, wherein like numerals denote like elements.

DETAILED DESCRIPTION

The following detailed description is exemplary in nature and is not intended to limit the scope, applicability, or configuration of the invention in any way. Rather, the following description provides practical illustrations for implementing exemplary embodiments of the present invention. Examples of constructions, materials and dimensions are provided for selected elements, and all other elements employ that which is known to those of skill in the field of the invention. Those skilled in the art will recognize that many of the examples provided have suitable alternatives that can be utilized.

Figure 1B:
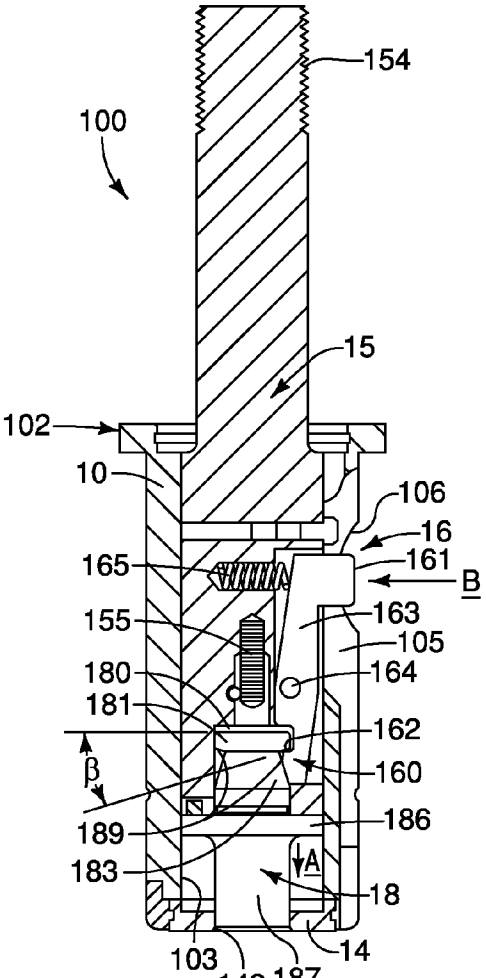
FIG. 1B is a partial cross-section view, of a portion of the assembly shown in FIG. 1A, through section line A-A of FIG. 1A, according to some embodiments.
Figure 1A:
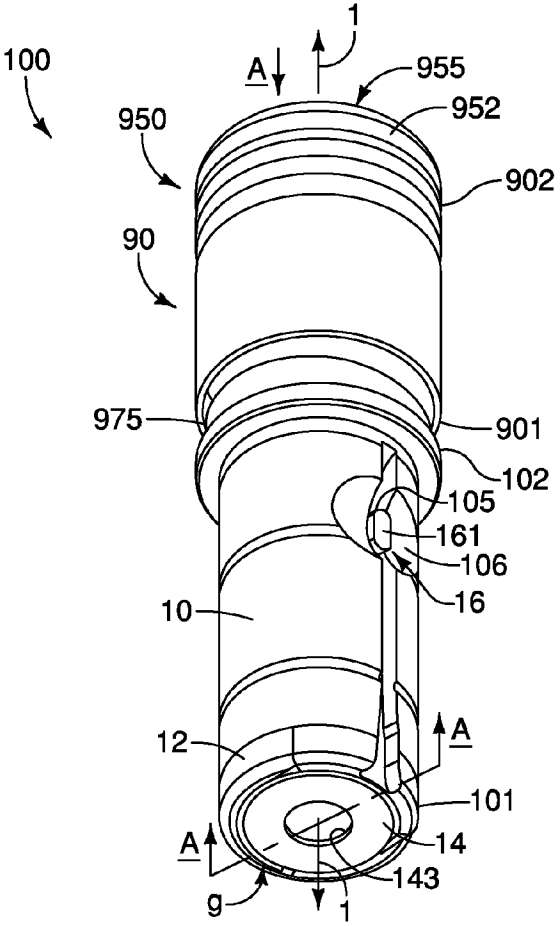
FIG. 1A is a perspective view of a punch assembly, according to some embodiments of the present invention.

FIG. 1A is a perspective view of a punch assembly 100, according to some embodiments of the present invention. FIG. 1A illustrates assembly 100 including a punch guide sidewall 10, a stripper plate 14, which is coupled to a first end 101 of sidewall 10, and a spring pack, or driver assembly 90, which is coupled to a second end 102 of sidewall 10. The coupling of stripper plate 14 to punch guide sidewall 10 will be described in greater detail, below, in conjunction with FIGS. 6A-E and 7A-B. Various embodiments of spring pack assemblies, which may be substituted for assembly 90, will be described, below, in conjunction with FIGS. 8A-11D, and assembly 90 will be described in conjunction with FIGS. 12A-E. FIG. 1A further illustrates punch guide sidewall 10 including an aperture 105 extending therethrough, in order to expose an actuation interface 161 of a retain-and-release member 16, which may be fully seen in the section view of FIG. 1B.

FIG. 1B is a partial cross-section view of a portion of assembly 100, through section line A-A of FIG. 1A, according to some embodiments. FIG. 1B illustrates a guide bore 103 formed by the extension of punch guide sidewall 10, from first end 101 to second end 102, and about a central longitudinal axis 1 of assembly 100 (FIG. 1A); a punch holder 15 and a releasable punch tip 18 of assembly 100 are shown slideably engaged within guide bore 103. With reference to FIG. 1C, which is a perspective view of punch guide sidewall 10, isolated from the rest of assembly 100, guide bore 103 may be more clearly seen, as well as aperture 105. FIG. 1B further illustrates retain-and-release member 16 including a retaining portion 160, and a pivot shaft 163, which extends between retaining portion 160 and actuation interface 161; pivot shaft 163 is shown pivotably coupled to a sidewall of punch holder 15, for example, via a pin member 164. According to the illustrated embodiment, retain-and-release member 16 is coupled to punch holder 15, in order to engage punch tip 18 in fixed relation thereto, by means of retaining portion 160 and a biasing force, which is applied via a member 165, for example, a spring.

Figure 1D:
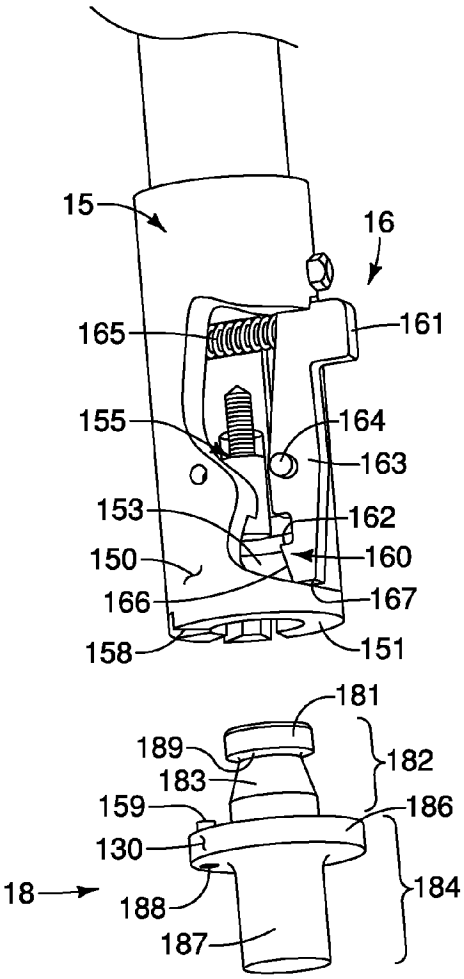
FIG. 1D is a perspective view of a portion of the assembly shown in FIG. 1A, showing a punch tip separated from a punch holder of the assembly, according to some embodiments.
Figure 1C:
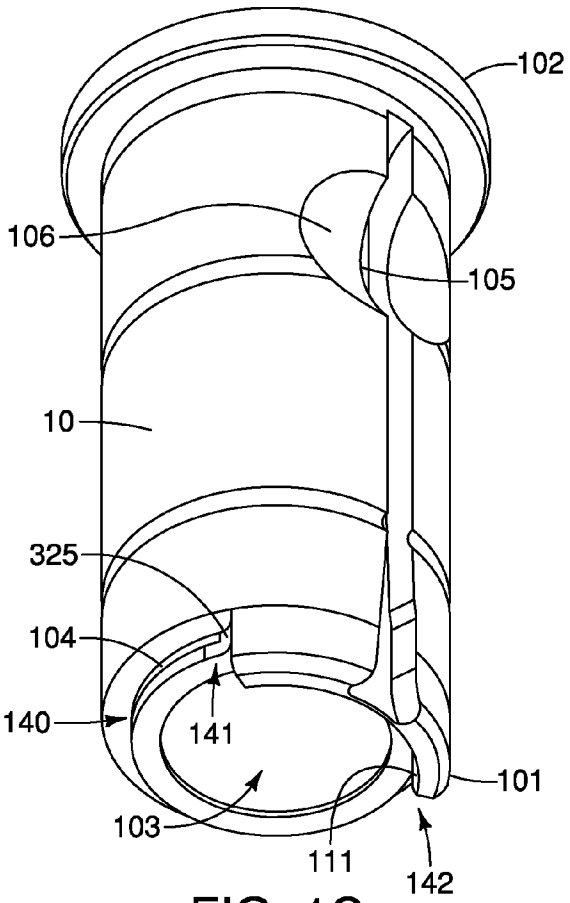
FIG. 1C is a perspective view of a punch guide portion of the assembly shown in FIG. 1A, isolated from the rest of the assembly, according to some embodiments.

Turning now to FIG. 1D, which is a perspective view of a portion of assembly 100 showing punch tip 18 separated from punch holder 15, a bore 153 of punch holder 15 may be seen, through a cut-away portion of holder 15, and a working portion 184 and a coupling portion 182 of punch tip 18 are identified. FIG. 1D illustrates coupling portion 182 of punch tip 18 including a flange 181 and a shank 183, which extends between flange 181 and working portion 184, and working portion 184 of punch tip 18 including a flange 186 and a punch blade 187, which extends longitudinally from flange 186. According to the illustrated embodiment, and with reference back to FIG. 1B, coupling portion 182 of punch tip 18 extends into bore 153, when engaged by retain-and-release member 16, and flange 186 is butted up against a first end 151 of punch holder 15, such that punch blade 187 extends longitudinally from punch holder 15. FIG. 1B illustrates a shoulder 162 of retaining portion 160 of retain-and-release member 16 contacting an under-surface 189 of flange 181, in order to engage coupling portion 182 of punch tip 18, and, thereby, create a 'self-seating' function between holder 15 and tip 18.

With reference to FIGS. 1A-B, those skilled in the art will appreciate that assembly 100 may be operably mounted within a turret bore of a turret-type punch press, such that a ram of the press may strike a surface of assembly 100, in proximity to a second end 902 of assembly 90, per arrow A. Such a ram strike will force punch holder 15 to move within guide bore 103, and, thereby, drive punch tip 18, per arrow A, through an opening 143 in stripper plate 14, in order to form an underlying workpiece, which is held upon a workpiece support surface of the press. According to the illustrated embodiment, aperture 105 extends longitudinally, over a length of punch guide sidewall 10, to provide clearance for actuation interface 161 of retain-and-release member 16 to move, when punch tip 18 is moved, per arrow A, in such a punching operation.

FIG. 1B further illustrates biasing member 165, which is located generally opposite actuation interface 161 in order to bias retain-and-release member 16 into the illustrated 'self-seating' engagement position. It should be appreciated that the biasing, along with the above-described engagement of coupling portion 182 of punch tip 18, by retaining portion 160, is sufficient to hold punch tip 18 in fixed relation to punch holder 15 during punching operations. During a downward stroke, per arrow A, when punch blade 187 encounters the workpiece, punch tip 18 may be forced deeper into bore 103, at which point, an angle β of under-surface 189 of flange 181 serves to tighten the engagement of retaining portion 160 against under-surface 189. Such tightening may provide for added resistance against an opposite force, that may be applied by the workpiece on the upward stroke. Angle β of under-surface 189 may be between 0 and approximately 30 degrees, with respect to an opposing face 180 of punch tip 18, which, when engaged by retain-and-release member 16, extends approximately orthogonal to central longitudinal axis 1. According to alternate embodiments, under-surface 189 may extend approximately orthogonal to axis 1, or under-surface 189 may extend at an angle generally opposite to the illustrated angle β, with respect to face 180 of punch tip 18, for example, at an angle that is between 0 and −10 degrees. External surfaces 150 and 130 of punch holder 15 and flange 186 of punch tip 18, respectively, together form a bearing surface, which interfaces with an internal surface of punch guide sidewall 10, during the punching operation, and the abutting surfaces of flange 186 and first end 151 of punch holder 15 further serve to stabilize punch tip 18 against any significant wobble, that is, lateral pivoting, during the punching operation. Punch tip 18 and retain-and-release member 16 are each preferably formed from an A8 steel, but any suitable tool steel, including powdered metals, may be employed. According to some preferred embodiments, punch tip 18 and release member 16 are hardened, via a heat treating process, known to those skilled in the art, and may include a nitride coating.

For modification of assembly 100, following punching operations, a force, applied to actuation interface 161, per arrow B, and toward central longitudinal axis 1, pushes against the biasing force of member 165, in order rotate pivot shaft 163 about coupling pin 164, and thereby disengage retaining portion 160 of retain-and-release member 16 from punch tip 18. An optional ejection member 155 is shown mounted in punch holder 15 and interfacing with punch tip 18, so as to provide an additional force, along central longitudinal axis 1, for ejecting punch tip 18, away from holder 15, when retain-and-release member 16 is disengaged from punch tip 18. With reference to FIGS. 1A-B, it may be appreciated that punch tip 18 may thus be readily removed from assembly 100, once stripper plate 14 is removed, without having to disassemble any of punch holder 15, punch guide sidewall 10 and spring pack assembly 90 from one another.

With reference back to FIG. 1D, portions of retain-and-release member 16 that are within punch holder 15 may be seen; and FIG. 1D illustrates biasing member 165 holding retaining portion 160 of retain-and-release member 16 in a fully biased first position, within bore 153, when punch tip 18 is separated from punch holder 15. FIG. 1D further illustrates retaining portion 160 including a camming surface 166, which extends between shoulder 162 and a terminal end 167 of retaining portion 160. Camming surface 166 is shown, at the first, fully biased position, being located within bore 153 to contact flange 181 of punch tip 18, in sliding relation, when coupling portion 182 of punch tip 18 is moved back into bore 153; this contact between flange 181 and camming surface 166, moves retaining portion 160 from the first, fully biased, position, thereby allowing retain-and-release member 16 to engage punch tip, as is shown in FIG. 1B, without the need to directly apply a force to activation interface 161. With further reference to FIG. 1D, flange 186 of punch tip 18 is shown having a hole 188 formed therethrough, in which a pin 159 is fitted, and a face of first end 151 of punch holder 15 is shown including a slot 158. According to the illustrated embodiment, when tip 18 is inserted into bore 153, pin 159 is engaged within slot 158 in order to key or align a footprint of punch blade 187 about central longitudinal axis 1 of assembly 100.

Although FIGS. 1A-D illustrate a single retain-and-release member 16, the scope of the present invention covers alternate embodiments wherein assembly 100 is configured to include a plurality of retain-and-release members 16 positioned circumferentially about assembly 100, for example, to provide increased stability to the engagement of punch tip 18 against punch holder 15 during punching operations. According to some alternate embodiments, at least one other retain-and-release member 16 is coupled to the sidewall of punch holder 15, on an opposite side to that shown, such that opposing fingers of a hand may push opposing actuation interfaces 161 inward, toward longitudinal central axis 1, in order to release punch tip 18 from the assembly. Furthermore, it should be understood that alternate embodiments of punch assemblies, which are configured such that one or more fingers of a hand may release a punch tip from a punch holder, while the punch holder remains within a guide bore of the assemblies, are within the scope of the present invention; and some examples of these alternate embodiments are described, below, in conjunction with FIGS. 2A-4B.

According to some preferred embodiments, an exterior surface of punch guide sidewall 10 allows a finger of a hand to access actuation interface 161 and to apply the aforementioned force, per arrow B (FIG. 1B), without need for a special tool. According to the illustrated embodiment, sidewall 10 further includes a recess 106 formed around aperture 105, so that, although actuation interface 161 protrudes from aperture 105, interface 161 is still slightly recessed from a majority of the external surface of punch guide sidewall 10.

Figure 1E:
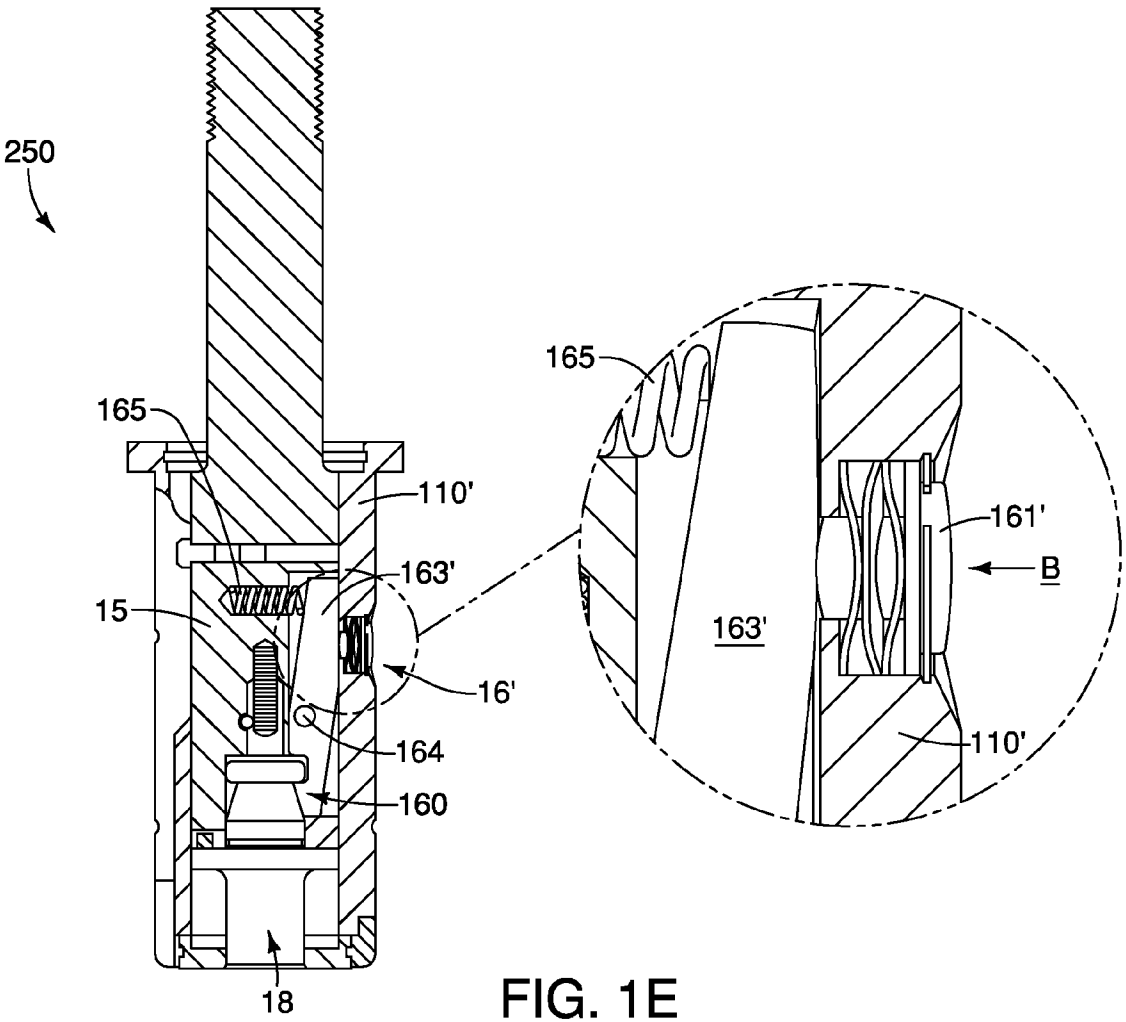
FIG. 1E is a partial cross-section view of a punch assembly, including an enlarged detailed view, according to yet further embodiments.

Although retaining portion 160 and actuation interface 161 of retain-and-release member 16, are shown as integral extensions of pivot shaft 163, it should be noted that, according to alternate embodiments, a retain-and-release member may comprise a sub-assembly of two or more individual components, which are more indirectly connected. For example, FIG. 1E is a partial cross-section view of a punch assembly 250, including an enlarged detailed view, wherein a retain-and-release member 16' is shown including an actuation interface formed as a separate button member 161'. FIG. 1E illustrates retain-and-release member 16' including a pivot shaft 163', which is pivotably coupled to punch holder 15, via pin member 164, and retaining portion 160, which extends from shaft 163'. According to the illustrated embodiment, button member 161' is mounted in an aperture formed in a punch guide sidewall 110' of assembly 250 so as to interface with a surface of pivot shaft 163' for actuation thereof, in a manner similar to that described, above, for assembly 100. FIG. 1E further illustrates button member 161' biased within the aperture, such that a force, which is applied to button member 161', per arrow B, needs to overcome both this biasing force and the biasing force of biasing member 165, in order rotate pivot shaft 163 about coupling pin 164, and thereby disengage retaining portion 160 of retain-and-release member 16 from punch tip 18.

Figure 1F:
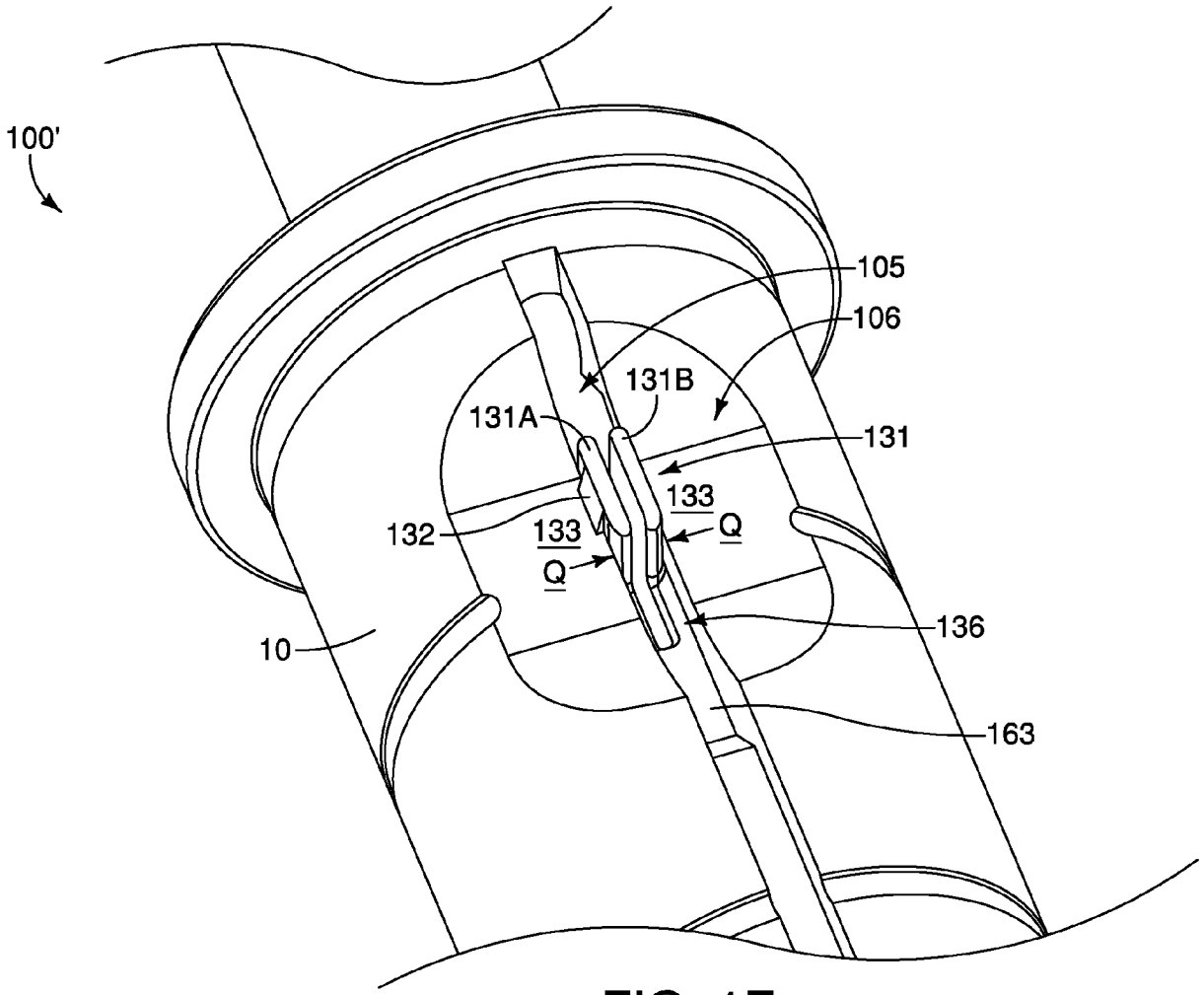
FIG. 1F is a perspective view of a portion of a punch assembly, according to some other embodiments.

With reference to FIG. 1F, retain-and-release members, of other embodiments of the present invention, include a locking feature to prevent inadvertent release of punch tip 18. FIG. 1F is a perspective view of a portion of a punch assembly 100', which is very similar to assembly 100. FIG. 1F illustrates assembly 100' differing from assembly 100, in that an actuation interface 131 of a retain-and-release member 136, of assembly 100', is formed by a pair of parallel and opposing sidewalls 131A, 131B, at least one of which has a locking feature 132 protruding from an outward facing surface thereof. Although, only locking feature 132 of sidewall 131A may be seen in FIG. 1F, it should be understood that another locking feature 132 may also protrude, similarly, from sidewall 131B, according to some embodiments. FIG. 1F further illustrates locking feature 132 engaging with a corresponding portion 133 of punch guide sidewall 10, within recess 106, alongside of aperture 105, so that an applied force, which is directed inward, for example, per arrow B (FIG. 1B), alone, is insufficient to disengage retain-and-release member 136 from a coupling portion of a punch tip of assembly 100', for example, coupling portion 182 of punch tip 18 (FIG. 1D). It should be noted that retain-and-release member 136 may be very similar, in other aspects, to the previously described retain-and-release member 16, and thus include retaining portion 160 and pivot shaft 163, which extends between retaining portion 160 and actuation interface 131, wherein pivot shaft 163 may be pivotably coupled to punch holder 15, via pin member 164 (FIG. 1B). Alternately, actuation interface 131 of retain-and-release member 136 may be formed as a separate button member, similar to button member 161' of retain-and-release member 16', as described in conjunction with FIG. 1E. According to the illustrated embodiment, another force, per arrow Q, which is applied to sidewalls 131A, 131B, will flex sidewalls 131A, 131B toward one another, in order to disengage locking feature 132 from punch guide sidewall 10; and, then, the aforementioned inward force may move actuation interface 131 into aperture 105 to rotate pivot shaft 163, and, thereby, release punch tip 18.

Figure 2B:
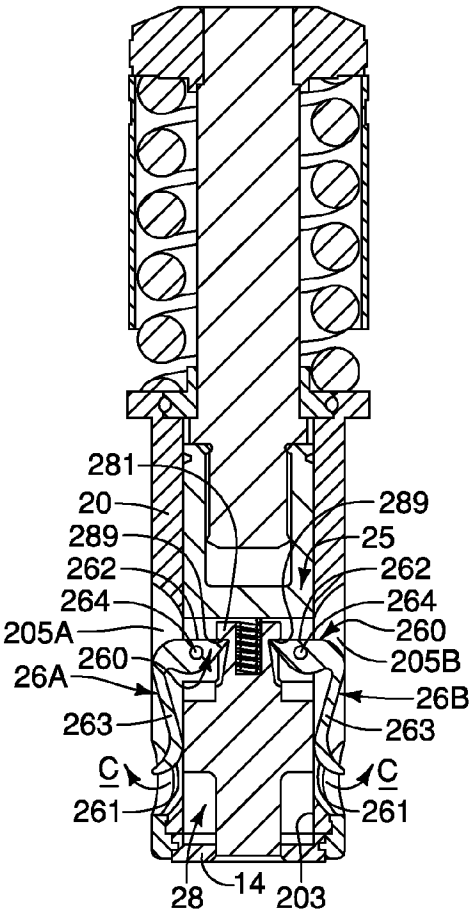
FIG. 2B is a cross-section view, through section line B-B of FIG. 2A, according to some embodiments.
Figure 2A:
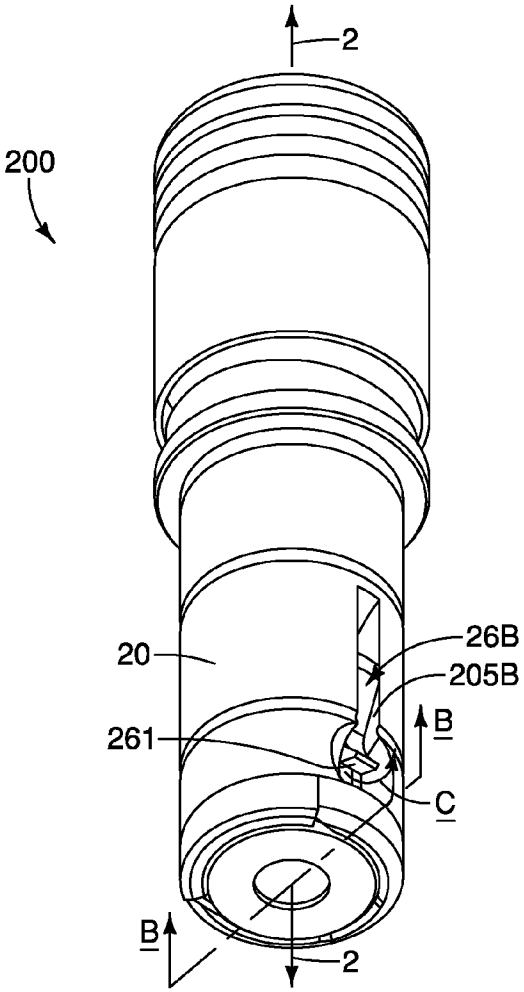
FIG. 2A is a perspective view of a punch assembly, according to some alternate embodiments of the present invention.

FIG. 2A is a perspective view of a punch assembly 200, according to some alternate embodiments of the present invention; and FIG. 2B is a cross-section view of assembly 200, through section line B-B of FIG. 2A, according to some embodiments. FIGS. 2A-B illustrate assembly 200 including a punch guide sidewall 20, through which a pair of apertures 205A, 205B extend, in order to expose actuation interfaces 261 of retain-and-release members 26A, 26B. FIG. 2B illustrates a guide bore 203, which is formed by punch guide sidewall 20, and in which a punch holder 25 and a punch tip 28 are slideably engaged, similar to assembly 100. FIG. 2B further illustrates a pivot shaft 263 of each retain-and-release member 26A, 26B pivotably coupled, via a pin member 264, to punch holder 25, and a retaining portion 260 of each retain-and-release member 26A, 26B including a shoulder 262, which engages an under-surface 289 of a flange 281 of punch tip 28, in order to hold punch tip 28 in fixed relation to punch holder 25 during punching operations.

According to the illustrated embodiment, each of apertures 205A, 205B in punch guide sidewall 20 provide access for a finger of a hand to apply a force, per arrow C, in order to disengage each retaining portion 260 from punch tip 28; the force is shown being directed outward and away from a central longitudinal axis 2 of assembly 200, in order to lift actuation interface 261 of retain-and-release member 26. Thus, once stripper plate 14 is removed from assembly 200, punch tip 28 may be released from punch holder 25, by the aforementioned application of force, which is applied from an exterior surface of punch guide sidewall 20, without the need for a special tool or for further disassembly of assembly 200. It should be noted that, according to alternate embodiments, assembly 200 may employ only one of retain-and-release members 26A, 26B, or may employ one or more retain-and-release members in addition to 26A and 26B.

Figure 3B:
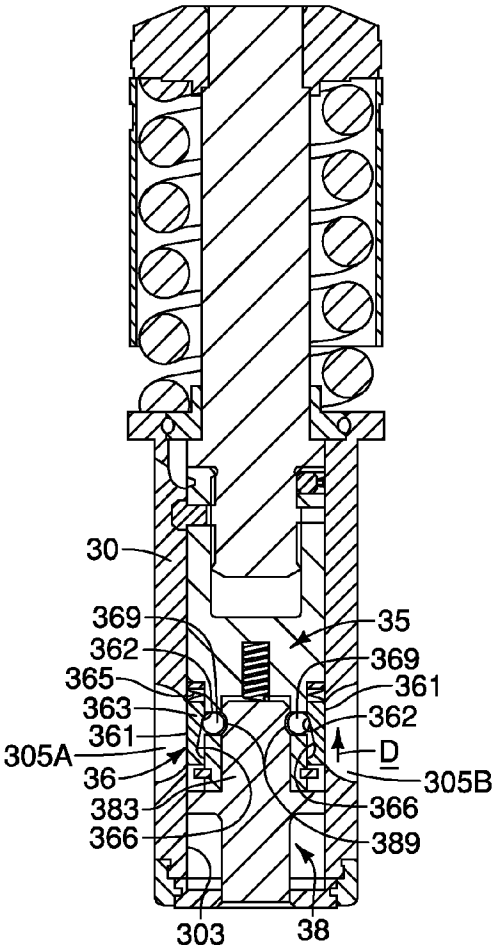
FIG. 3B is a cross-section view, through section line C-C of FIG. 3A, according to some embodiments.
Figure 3A:
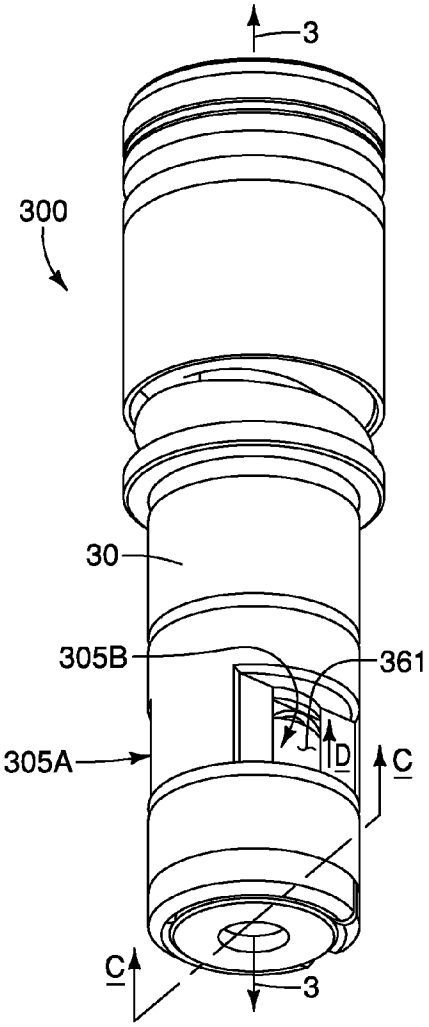
FIG. 3A is a perspective view of a punch assembly, according to some additional embodiments of the present invention.

FIG. 3A is a perspective view of a punch assembly 300, according to some additional embodiments of the present invention; and FIG. 3B is a cross-section view, through section line C-C of FIG. 3A, according to some embodiments. FIGS. 3A-B illustrate assembly 300 including a punch guide sidewall 30, through which a pair of apertures 305A, 305B extend, in order to expose an actuation interface 361 of a retain-and-release member 36. FIG. 3B illustrates a guide bore 303, which is formed by punch guide sidewall 30, and in which a punch holder 35 and a punch tip 38 are slideably engaged, similar to assemblies 100, 200. Punch tip 38 is shown including a shank 383 in which an external and circumferentially extending groove 389 is formed. FIG. 3B further illustrates retain-and-release member 36 including a collar 363, which is slideably mounted about an exterior surface of punch holder 35, and is biased into the illustrated position via a biasing member 365, and a plurality of spherical members 369, for example, ball bearings, which fit within groove 389 of punch tip 38, and are held within groove 389 by an inner engagement surface 362 of collar 363.

According to the illustrated embodiment, retain-and-release member 36 engages punch tip 38, via the biasing of collar 363 that positions inner engagement surface 362 to hold spherical members 369 within groove 389, so that punch tip 38 is held in fixed relation to punch holder 35 during punching operation. Apertures 305A, 305B provide access to interaction interface 361, so that opposing fingers of a hand may apply a force to slide collar 363, per arrow D, approximately parallel with a central longitudinal axis 3 of assembly 300, and thereby move inner engagement surface 362 of collar 363 out of contact with spherical members 369, so that spherical members 369 will move out from groove 389 and into an inner recess 366 formed in collar 363. Thus, movement, per arrow D, of collar 363 releases punch tip 38 from locking engagement by retain-and-release member 36.

Figure 4C:
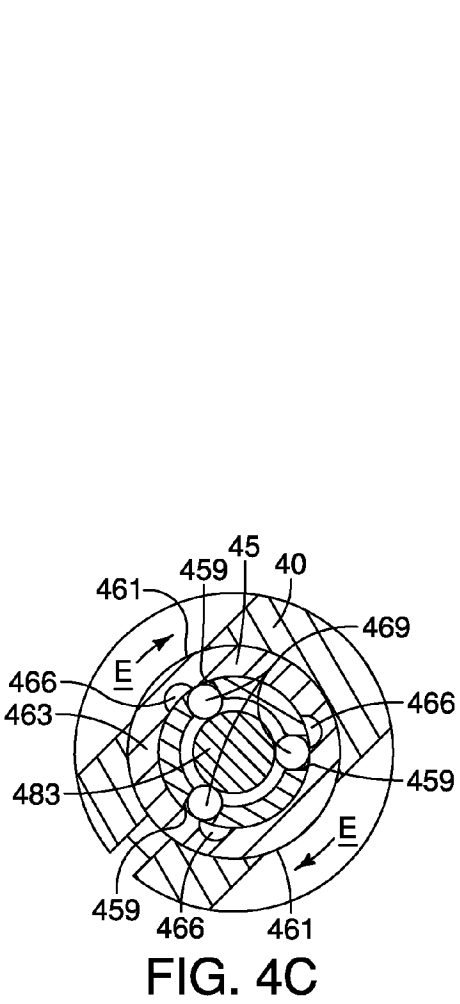
FIG. 4C is a cross-section view through section line D2-D2 of FIG. 4B, according to some embodiments.
Figure 4B:
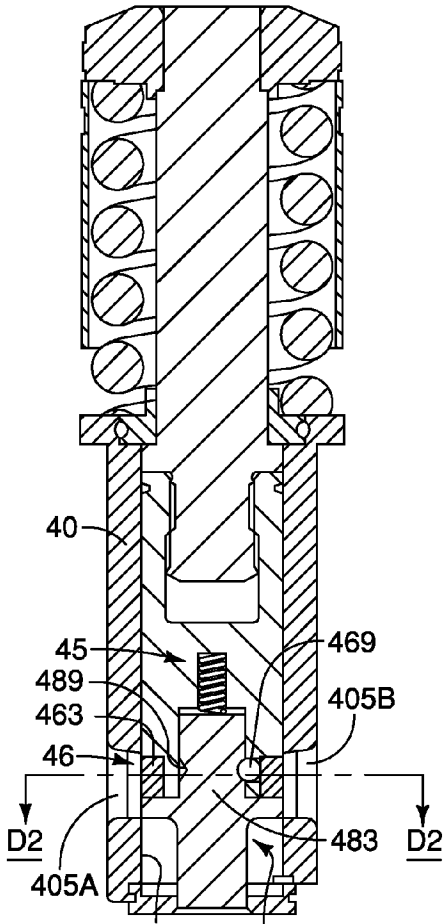
FIG. 4B is a cross-section view, through section line D1-D1 of FIG. 4A, according to some embodiments.
Figure 4A:
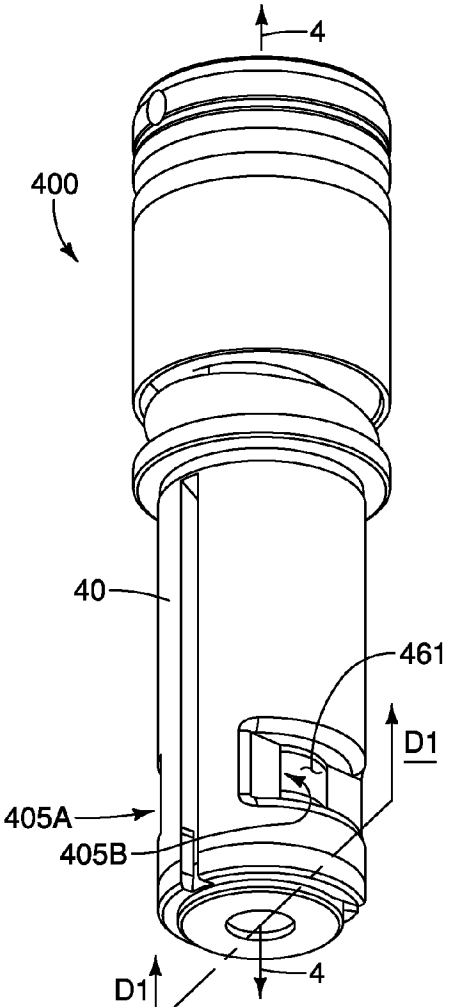
FIG. 4A is a perspective view of a punch assembly, according to yet further embodiments of the present invention.

FIG. 4A is a perspective view of a punch assembly 400, according to yet further embodiments of the present invention; and FIG. 4B is a cross-section view, through section line D1-D1 of FIG. 4A, according to some embodiments. FIGS. 4A-B illustrate assembly 400 including a punch guide sidewall 40, through which a pair of apertures 405A, 405B extend, in order to expose an actuation interface 461 of a retain-and-release member 46. FIG. 4B illustrates a guide bore 403, which is formed by punch guide sidewall 40, and in which a punch holder 45 and a punch tip 48 are slideably engaged, similar to assemblies 100, 200 and 300. Punch tip 48 is shown including a shank 483 in which an external and circumferentially extending groove 489 is formed. FIG. 4B further illustrates retain-and-release member 46 including a collar 463, which is mounted about an exterior surface of punch holder 45; an external surface of collar 463 is shown forming actuation interface 461.

FIG. 4C is a cross-section view through section line D2-D2 of FIG. 4B, according to some embodiments, wherein a plurality of spherical members 469, for example, ball bearings, are shown engaged within groove 489 of punch tip 48, so as to engage punch tip 48 in fixed relation to punch holder 45. FIG. 4C further illustrates collar 463 including a plurality of inward-facing recesses 466 formed in an inner surface thereof. According to the illustrated embodiment, collar 463 is biased to hold spherical members 469 within groove 489, yet is mounted to be rotated, per arrows E, with respect to holder 45, about a central longitudinal axis 4 of assembly 400, in order to release punch tip 48 from assembly 400, by aligning each of the plurality of inward-facing recesses 466 with a corresponding spherical member 469, so that each spherical member 469 moves out from groove 489 and into the corresponding inward-facing recess 466 of collar 463. With reference to FIGS. 4A-C, it may be appreciated that apertures 405A, 405B provide access, to actuation interface 461 of retain-and-release member 46, for opposing fingers of a hand, so that punch tip 48 may be released from assembly 400, without having to disassemble other portions of assembly 400.

Figure 5A:
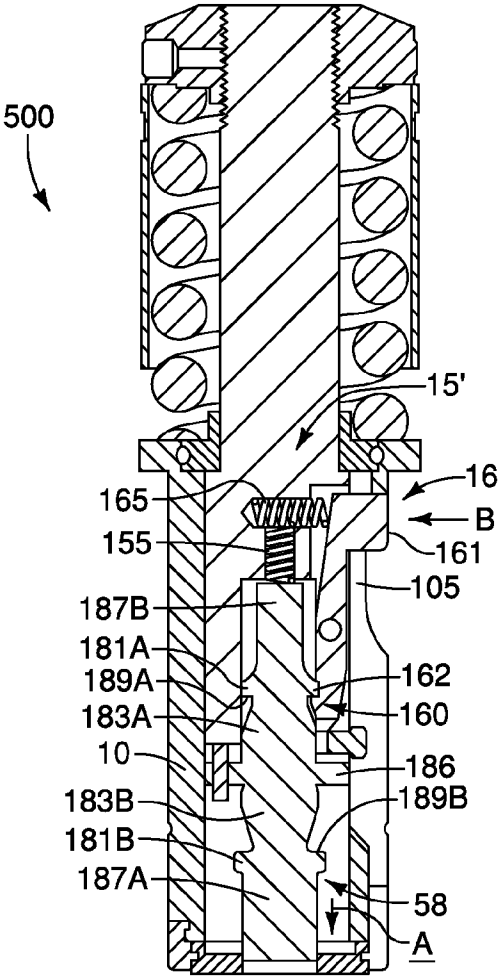
FIG. 5A is a cross-section view through section line A-A of FIG. 1A, according to some alternate embodiments of the present invention.

FIG. 5A is a cross-section view, through section line A-A of FIG. 1A, of a punch assembly 500, which is similar to assembly 100 of FIGS. 1A-B, but includes a modified punch holder 15', in order to employ a double-bladed punch tip 58, according to some alternate embodiments of the present invention. FIG. 5A illustrates flange 186 of punch tip 58, like punch tip 18, being butted up against an end of a punch holder 15', such that a first working portion 187A of tip 58 extends longitudinally from punch holder 15', while a second working portion 187B of tip 58 is enclosed within punch holder 15'. FIG. 5A further illustrates a first coupling portion of punch tip 58 including a first shank 183A, which extends to an undersurface 189A of a first flange 181A, which undersurface 189A is engaged by retaining portion 160 of retain-and-release member 16. According to the illustrated embodiment, first working portion 187A may be exchanged for second working portion 187B, by releasing punch tip 58 from assembly 500, via actuation interface 161 of retain-and-release member 16, as previously described, and then re-orienting punch tip 58 to insert first working portion 187A and a second coupling portion of punch tip 58 into holder 15'. The second coupling portion of punch tip 58 includes a second shank 183B, which extends to an undersurface 189B of a second flange 181B, wherein the second coupling portion is a mirror image, across flange 186, of the aforementioned first coupling portion of punch tip 58.

Figure 5B:
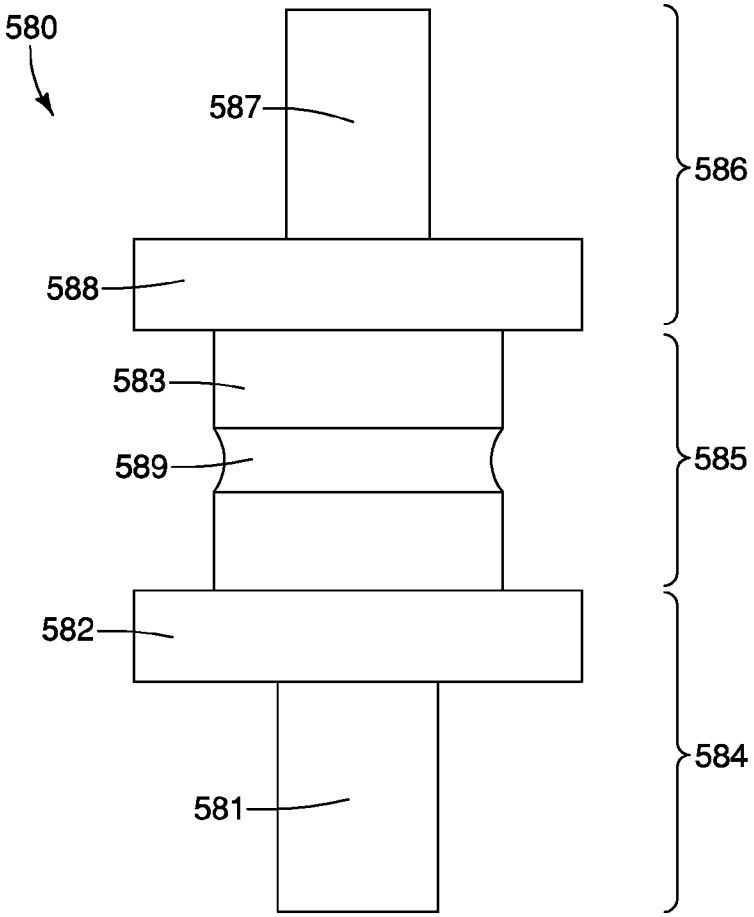
FIG. 5B is a plan view of a punch tip, which may be employed by additional alternate embodiments.

FIG. 5B is a plan view of a punch tip 580, which may be employed by additional alternate embodiments. FIG. 5B illustrates punch tip 580 including a coupling portion 585, a first working portion 584, which extends longitudinally from a first side of coupling portion 585, and a second working portion 586, which extends longitudinally from a second side of coupling portion 585, opposite first working portion 584. FIG. 5B further illustrates coupling portion 585 including a shank 583 in which a groove 589 is formed. According to the illustrated embodiment, a retain-and-release member, for example, member 36 (FIGS. 3A-B), may engage groove 589 of punch tip 58 to hold punch tip 58 in fixed relation to a punch holder, either in a first orientation, wherein first working portion 584 extends longitudinally from the punch holder, or in a second orientation, wherein second working portion 586 extends longitudinally from the punch holder.

Figure 6B:
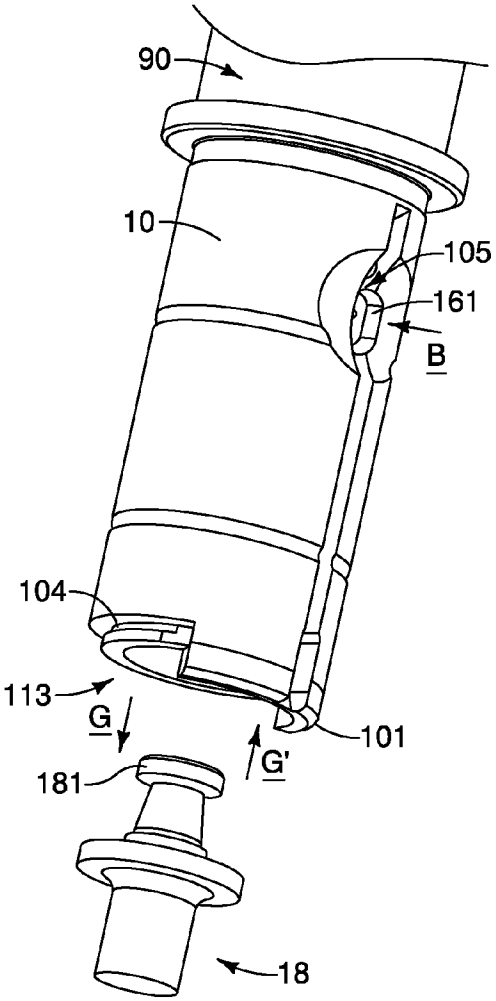
FIGS. 6A-B are perspective views of a portion of the assembly shown in FIG. 1A, each showing the assembly at a different stage of disassembly, according to some methods of the present invention.
Figure 6A:
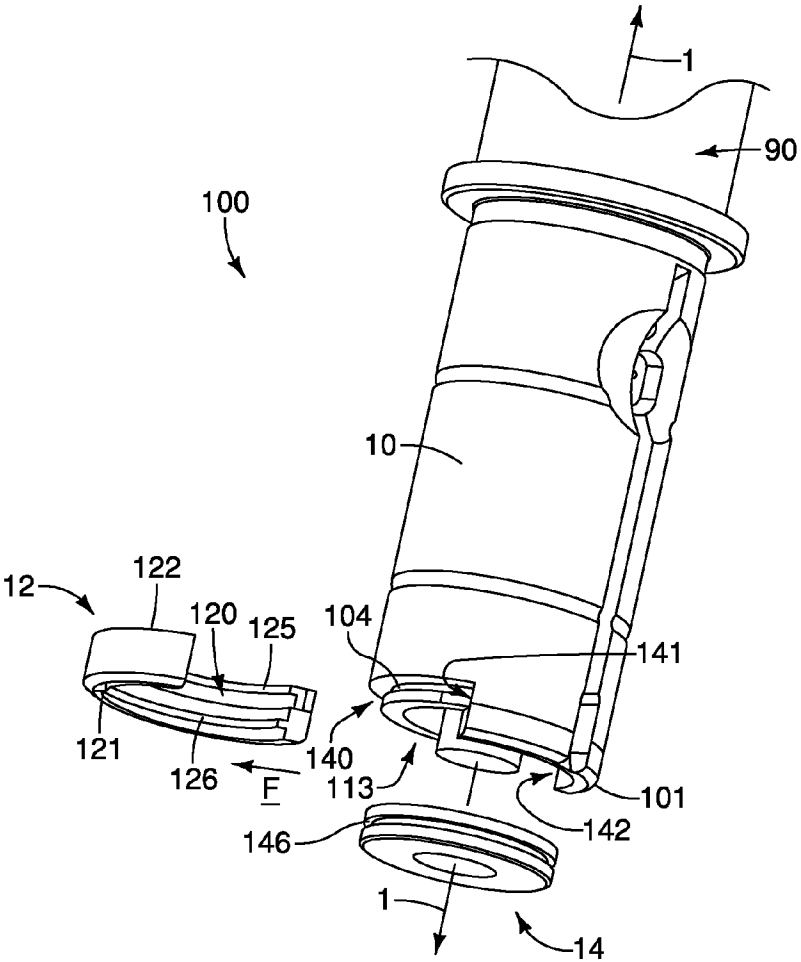

FIGS. 6A-B are perspective views of a portion of assembly 100 (FIGS. 1A-D), each showing assembly 100 at a different stage of disassembly, according to some methods of the present invention. FIG. 6A illustrates assembly 100 including a stripper plate retaining clip 12, which has been disengaged from an external surface 140 of punch guide sidewall 10, by pulling clip 12 outward, away from central longitudinal axis 1, per arrow F, and thereby allowing stripper plate 14 to fall away from an opening 113 of guide bore 103 at first end 101 of punch guide sidewall 10. FIG. 6B illustrates punch tip 18 having been released from assembly 100, by pushing against actuation interface 161 of retain and release member 16, per arrow B, such that punch tip 18 has dropped out through guide bore opening 113, per arrow G.

Thus, according to preferred methods of the present invention, once stripper plate 14 is removed from over opening 113, punch tip 18 may be removed from assembly 100 by actuating retain-and-release member 16 through aperture 105 of punch guide sidewall 10, as is illustrated in FIG. 6B. As previously described, this actuation may be accomplished, by pressing, per arrow B, against actuation interface 161, with at least one finger of a hand, without need for a special tool. Punch tip 18 may be removed, in this manner, to make way for another punch tip, or for subsequent replacement of punch tip 18 following grinding/sharpening. As is also described above, any of retain-and-release members 26, 36, 46 may be externally actuated to remove the corresponding punch tips from assemblies 200, 300, 400, respectively.

With further reference to FIG. 6B, punch tip 18 may be inserted into guide bore 103, per arrow G', for example, after grinding, and back into engagement with retain-and-release member 16 of punch holder 15. As previously described, in conjunction with FIG. 1D, contact between flange 181 of punch tip 18 and camming surface 166 of retaining portion 160, when coupling portion 182 of punch tip 18 is moved back into bore 153, moves retaining portion 160 from the first, fully biased, position, thereby allowing retain-and-release member 16 to re-engage punch tip 18. If a punch tip having an opposing pair of working portions, for example, similar to punch tip 58 of FIG. 5, is employed, upon release, the punch tip may be re-oriented to position one of the pair of working portions that, when previously engaged, extended from punch holder 15, within bore 153 of punch holder 15, so that the other of the pair of working portions can extend from punch holder 15.

Figure 7A:
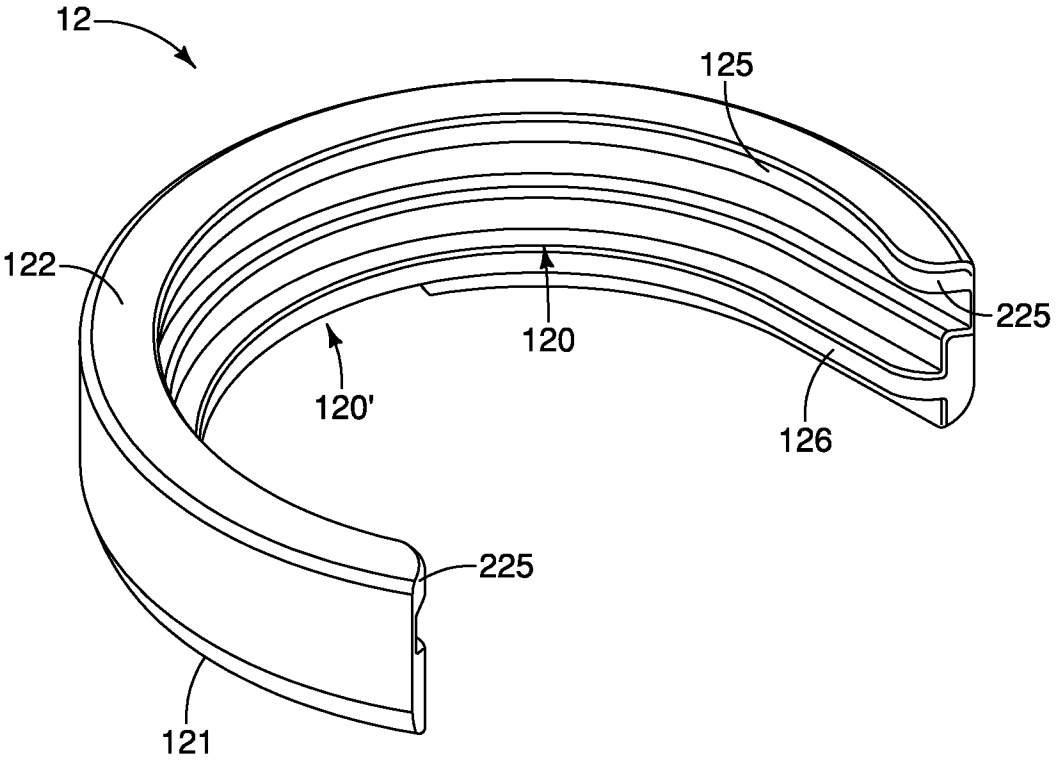
FIG. 7A is a perspective view of a stripper plate retaining clip, according to some embodiments of the present invention.

FIG. 6A further illustrates external surface 140 of punch guide sidewall 10 extending from a first end 141 thereof to a second end 142 thereof, about a portion of a perimeter of punch guide sidewall 10, being recessed, along central longitudinal axis 1, from first end 101 of punch guide sidewall 10, and including a circumferentially extending engaging feature 104, for example, a groove. External surface 140 may also be seen in FIG. 1C. With reference to FIG. 7A, which is a perspective view of stripper plate retaining clip 14, isolated from the rest of assembly 100, along with FIGS. 1C and 6A, stripper plate retaining clip 12 is shown including a first circumferentially extending mating feature 125, for example, a protrusion, which is sized and positioned along an internal surface 120 of clip 12 to engage within engaging feature 104 of punch guide sidewall 10. According to the illustrated embodiment, mating feature 125 includes optional raised ends 225, which each snap fit into a corresponding pocket 325, located at either end 141, 142 of external surface 140, one of which may be best seen in FIG. 1C; retaining clip 12 is preferably formed to have a spring force that cooperates with optional raised ends 225, in order to hold clip 12 in engagement with punch guide sidewall 10, as is illustrated in FIG. 1A, when mating feature 125 is engaged within engaging feature 104. With further reference to FIG. 1A, in conjunction with FIG. 6A, a thickness of stripper plate retaining clip 12, which is defined between a first end surface 121 thereof and a second end surface 122 thereof, is such that first end surface 121 is approximately flush with first end 101 of punch guide sidewall 10, when clip 12 is engaged with sidewall 10.

FIGS. 6A and 7A further illustrate retaining clip 12 including a second circumferentially extending mating feature 126. According to the illustrated embodiment, second mating feature 126 of retaining clip 12, for example, a protrusion, is sized and positioned along internal surface 120 of clip 12, with respect to first mating feature 125, in order to engage within an engaging feature 146 (FIG. 6A), for example, a groove, of stripper plate 14, when first mating feature 125 is engaged within engaging feature 104 of external surface 140 of punch guide sidewall 10, and thereby hold stripper plate 14 over guide bore opening 113, as is illustrated in FIG. 1A. With reference back to FIG. 1C, guide sidewall 10 is shown including an internal mating feature 111, for example, a protrusion, extending circumferentially about guide bore 103, along an internal surface of sidewall 10 at first end 101 thereof. According to the illustrated embodiment, mating feature 111 works in conjunction with clip 12 to hold stripper plate 14 over guide bore opening 113, by also engaging within engaging feature 146 of stripper plate 14.

FIGS. 1A, 6A and 7A further illustrate internal surface 120 of retaining clip 12 including a recessed portion 120'. According to the illustrated embodiment, when retaining clip 12 engages with stripper plate 14, a gap g exists between recessed portion 120' and plate 14 (FIG. 1A), in order to provide access to a finger or a tool. The access can facilitate the pulling of clip 12 outward, away from central longitudinal axis 1, per arrow F (FIG. 6A), in order to disengage clip 12 from stripper plate 14 and punch guide sidewall 10, and thereby remove stripper plate 14 from over guide bore opening 113. Of course, some other, alternate, embodiments of clip 12 may employ another type of feature, for example, located on an exterior surface of clip 12, in order to facilitate the pulling of clip 12, per arrow F. It should be noted that any of the punch guide sidewalls of the other assemblies 200, 300, 400 (FIGS. 2A-4B) may be configured to employ a stripper plate retaining clip, similar to clip 12, so that the previously described modification methods may be employed for assemblies 200, 300, 400.

Figure 7B:
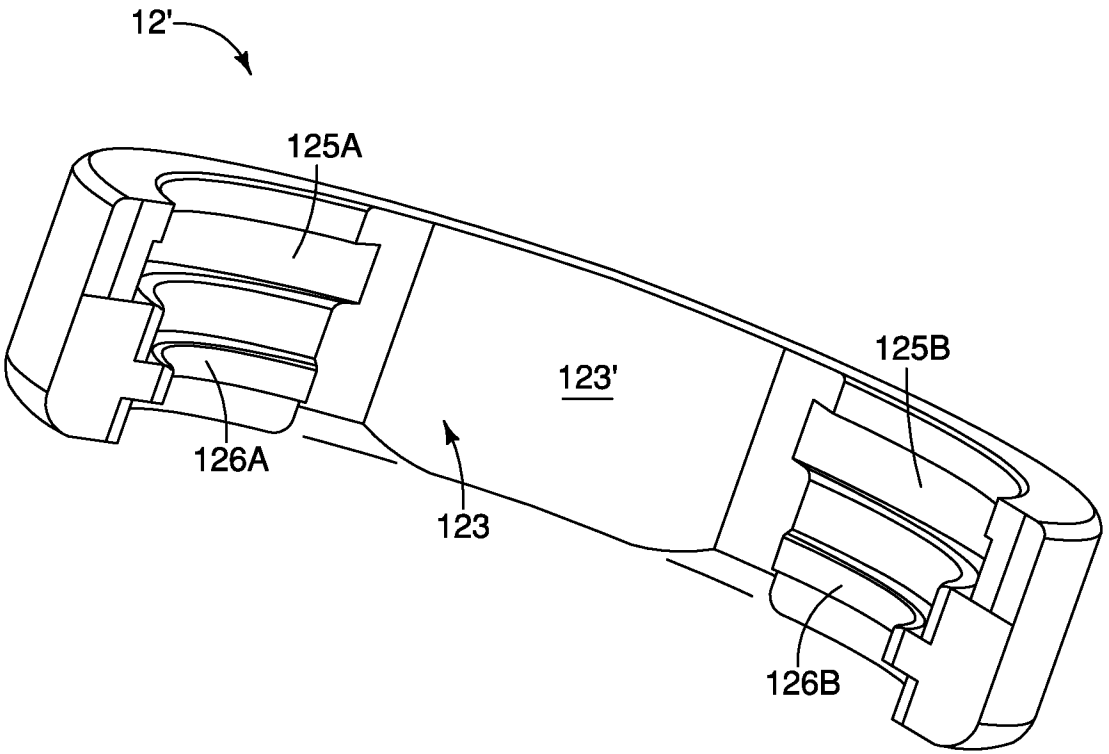
FIG. 7B is a perspective view of an alternate embodiment of a stripper plate retaining clip.

FIG. 7B is a perspective view of an alternate embodiment of a stripper plate retaining clip 12'. FIG. 7B illustrates a pair of first mating feature segments 125A, 125B, which generally correspond to the above-described mating feature 125 of clip 12, and a pair of second mating feature segments 126A, 126B, which generally correspond to the above-described mating feature 126 of clip 12. Segments 125A, 126A are shown circumferentially spaced apart from segments 125B, 126B, about an inner surface 123 of clip 12', such that a portion 123' of inner surface 123, similar to the above-described recessed portion 120' of clip 12, provides gap g between clip 12' and stripper plate 14, when clip 12' engages stripper plate 14, in order to facilitate the disengaging of clip 12' from stripper plate 14, for example, as illustrated for clip 12 in FIG. 6A, by pulling, per arrow F.

Figure 6D:
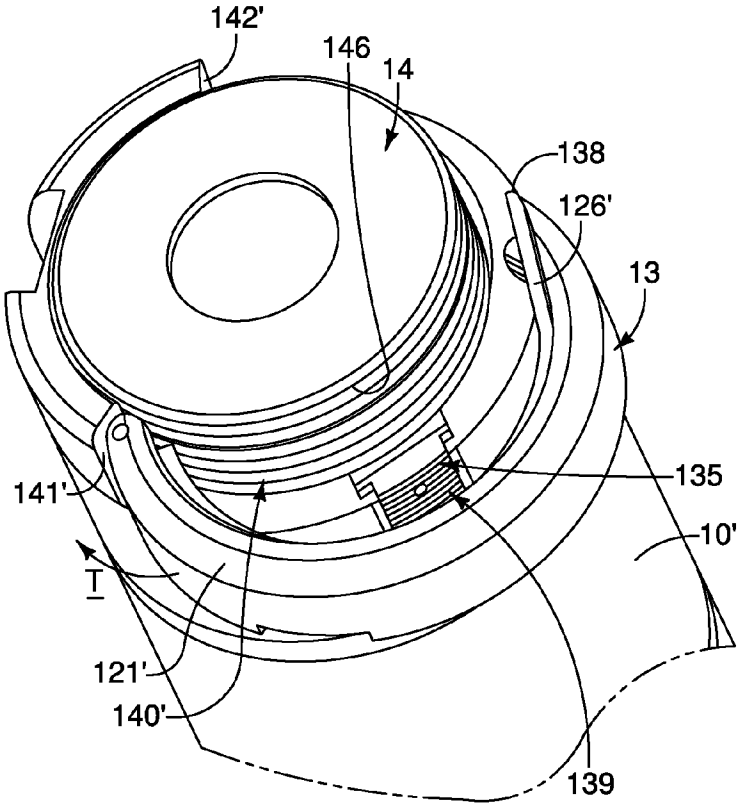
FIG. 6D is another perspective view of the portion of the assembly shown in FIG. 6C.
Figure 6C:
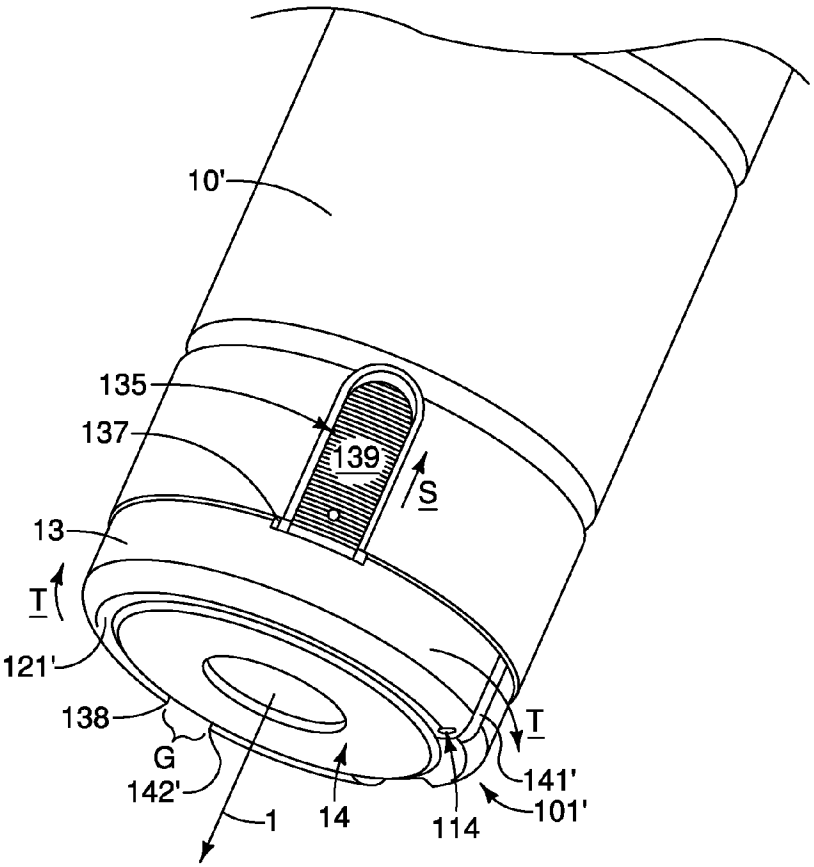
FIG. 6C is a perspective view of a portion of a punch assembly, which allows for disassembly according to some alternate methods.

FIG. 6C is a perspective view of a portion of a punch assembly, which allows for disassembly according to some alternate methods. The punch assembly of FIG. 6C may be very similar to punch assembly 100, yet differing with respect to features related to retention and release of a stripper plate retaining clip 13. FIG. 6C illustrates retaining clip 13 coupled to a first end 101' of a punch guide sidewall 10', by a pivot joint 114, for example, formed by pin 114A that extends from sidewall 10' and through a bore 1148 of clip 13 (FIG. 6E); clip 13 is shown in a first position, closed around a perimeter of stripper plate 14, to hold stripper plate 14 over an opening of a guide bore formed by punch guide sidewall 10'. FIG. 6D, which is another perspective view, shows retainer clip 13 having been disengaged from stripper plate 14, by pivoting, or rotating, clip 13 to a second position, away from punch guide sidewall 10' and in a plane approximately orthogonal to central longitudinal axis 1 (FIGS. 6A and 6D), per arrow T, so that plate 14 may be removed from over the opening of the guide bore.

Figure 6E:
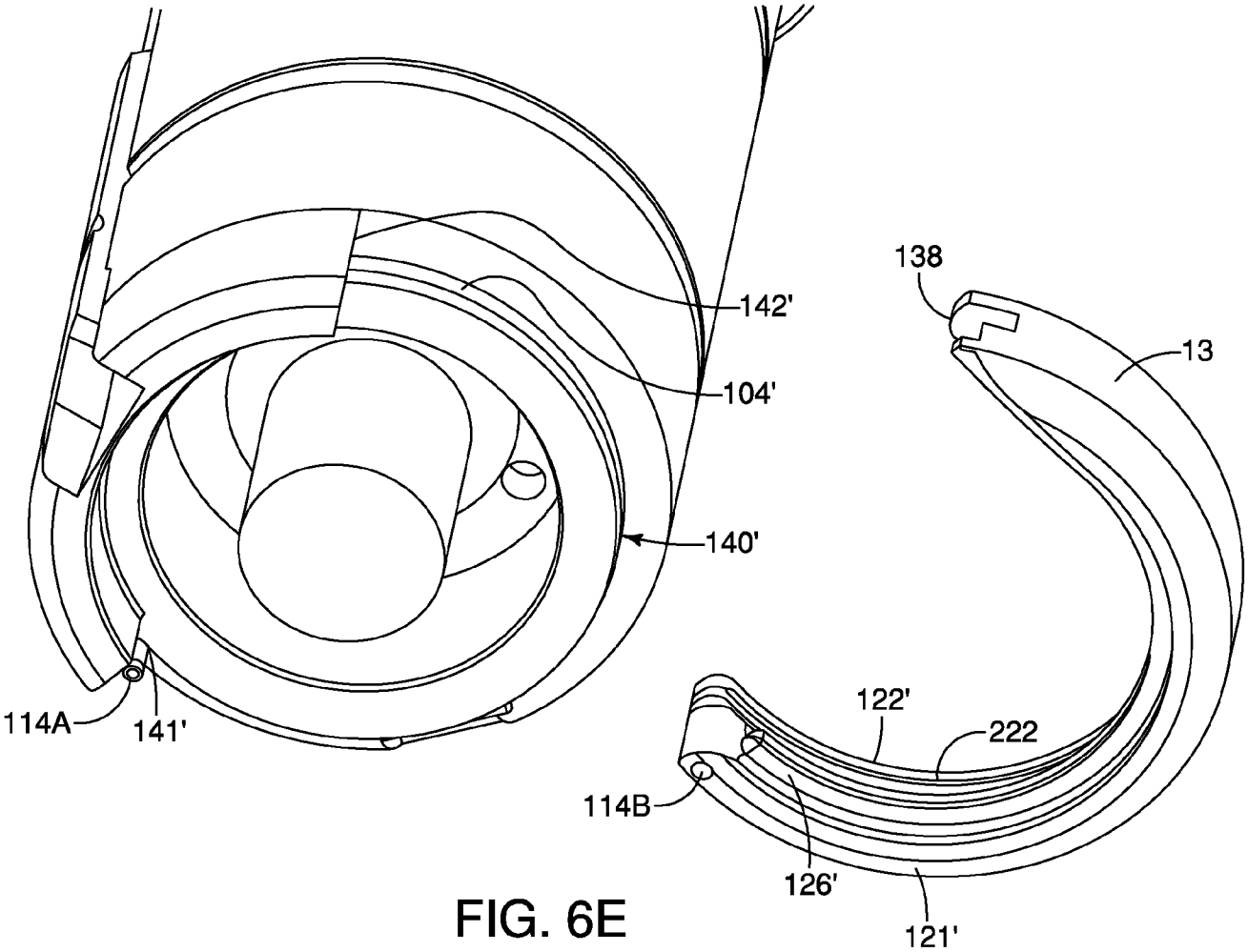
FIG. 6E is an exploded perspective view of the portion of the assembly shown in FIG. 6C.

FIG. 6E is an exploded perspective view of the punch assembly, without stripper plate 14. FIG. 6E illustrates an engaging feature 104' formed in an external surface 140' of punch guide sidewall 10', for engaging a mating feature 222 of clip 13; mating feature 222 of clip 13 is shown as a circumferentially extending shoulder, or protrusion, extending longitudinally from a second end surface 122' of clip 13. FIG. 6E further illustrates another mating feature 126' of clip 13 for engaging with engaging feature 146 of stripper plate 14 (FIG. 6A,D), as previously described for assembly 100.

With reference to FIGS. 6C-E, it may be appreciated that external surface 140' extends from a first end 141' thereof to a second end 142' thereof about a portion of a perimeter of punch guide sidewall 10' and is longitudinally recessed from first end 101' of punch guide sidewall 10', similar to surface 140 of sidewall 10 of assembly 100, so that, when feature 104' engages clip 13, a first end surface 121' of clip 13 is approximately flush with first end 101'. FIGS. 6C and 6E further illustrate clip 13 including a terminal end 138, which is, preferably, spaced apart from second end 142' of external surface, when clip 13 is engaged with sidewall 10'; this spacing provides access, via a gap G, for a finger of a hand, or a tool, to engage terminal end 138 for pivoting clip per arrow T.

FIGS. 6C-D further illustrate a releasable locking member 135 coupled to punch guide sidewall 10', in proximity to external surface 140'. In FIG. 6C, locking member is shown engaging an interface 137 of stripper plate retaining clip 13, which interface 137 is formed as an external recess, in proximity to second end surface 122' (FIG. 6E) of clip 13. According to the illustrated embodiment locking member 135 is biased to extend into interface 137, in order to prevent clip 13 from pivoting away from punch guide sidewall 10', and may be moved, to unlock clip 13, by applying a force, per arrow S, to an external actuation interface 139 thereof. A spring member (not shown), attached to an under-surface of locking member 135, may bias locking member 135 into the locked position shown in FIG. 6C. The spring member may be mounted within a groove, that is formed in an outer surface of punch guide sidewall 10' and underlies locking member 135. According to some methods of the present invention, once locking member 135 is moved, per arrow S, clip 13 may be pivoted per arrow T to release stripper plate 14 from the punch assembly.

Punch assemblies, according to some additional embodiments of the present invention, include one or more features that facilitate adjustment of an axial position of a punch tip, with respect to a punch driver, or head, within a punch assembly, upon release of a locking member. Such an adjustment may be necessary to account for a change in length of a particular punch tip following grinding to re-sharpen the tip, or to account for variability among the length of interchangeable releasable punch tips, for example, as are employed by the embodiments described above. One example of a punch assembly that incorporates features for this type of adjustment is disclosed in commonly assigned U.S. Pat. No. 5,131,303, which is hereby incorporated by reference; adjustment features similar to those disclosed in patent '303 may be incorporated by embodiments of the present invention, for example, as is described below, in conjunction with FIGS. 8A-B. Other embodiments of the present invention, which incorporate subassemblies for the adjustment of an axial position of a punch tip within an punch tool assembly, will also be described, in conjunction with FIGS. 9A-12E. It should be noted that punch tools including adjustment subassemblies of the present invention may, or may not, also include the above-described inventive features for a releasable punch tip; thus, in subsequent descriptions, although punch holders are described as including the features for interfacing with the adjustment subassemblies, it should be understood that punch bodies, including integrally formed punch tips, may be interchanged therewith, according to alternate embodiments.

Figure 8B:
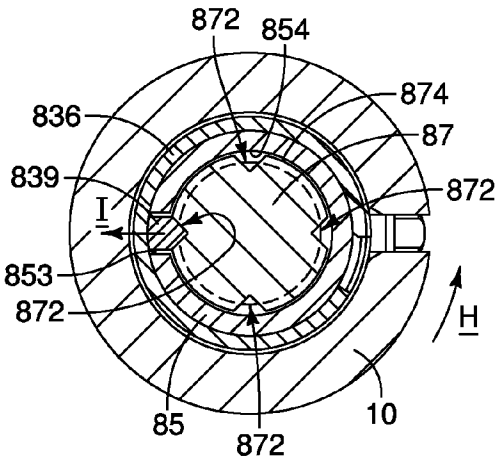
FIG. 8B is a radial cross-section view of the assembly shown in FIG. 8A, through section line E-E of FIG. 8A.
Figure 8A:
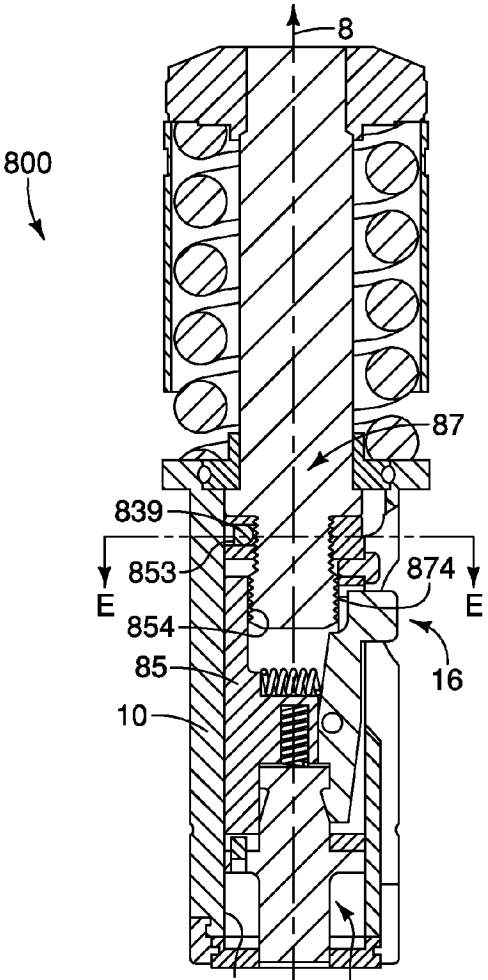
FIG. 8A is an axial cross-section view through a punch assembly, according to some additional embodiments of the present invention.

FIG. 8A is an axial cross-section view through a punch assembly 800, according to some additional embodiments of the present invention; and FIG. 8B is a radial cross-section view, through section line E-E of FIG. 8A. FIG. 8A illustrates assembly 800 including a punch holder 85 to which retain-and-release member 16 is coupled to engage releasable punch tip 18, as previously described for assembly 100 (FIGS. 1A-D), such that holder 85 and tip are slideably engaged together within guide bore 103 of punch guide sidewall 10. FIG. 8A further illustrates punch holder 85 including an internal threaded surface 854 engaged within an external threaded surface 874 of a punch driver, or head 87. According to the illustrated embodiment, when driver 87 is rotated about a central longitudinal axis 8, with respect to punch holder 85, holder 85 will be caused to move along central longitudinal axis 8, resulting in a new axial position of punch tip 18 with respect to driver 87. Of course, holder 85 may alternately include the external threaded surface and driver 87 the internal threaded surface, according to alternate embodiments.

FIGS. 8A-B illustrate a releasable locking member, in the form of a retaining clip 836, engaged about punch holder 85, and a cam pin 839, protruding through an opening 853 in punch holder 85 to engage within a notch 872, that is formed in external threaded surface 874 of driver 87. FIGS. 8A-B further illustrate retaining clip 836 being secured around holder 85, by punch guide sidewall 10, in order to hold camming pin 839 in notch 872 and thereby lock a rotation of driver 87 with respect to holder 85. According to the illustrated embodiment, when punch guide sidewall 10 is moved away from clip 836 and punch holder 85, and driver 87 is rotated per arrow H, with respect to holder 85, cam pin 839 of the locking member is free to ride out from notch 872, per arrow I, thereby placing the locking member in an unlocked position, which allows for further relative rotation that results in movement of punch holder 85 along central longitudinal axis 8.

Figure 9B:
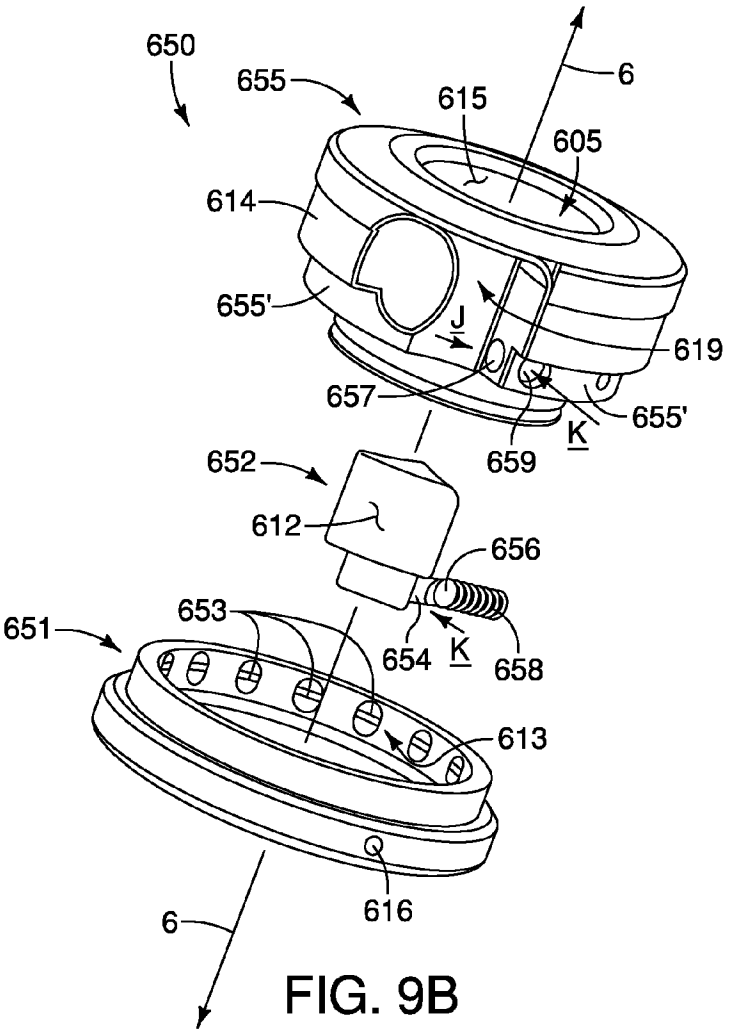
FIG. 9B is an exploded perspective view of a portion of the assembly of FIG. 9A, according to some embodiments.
Figure 9A:
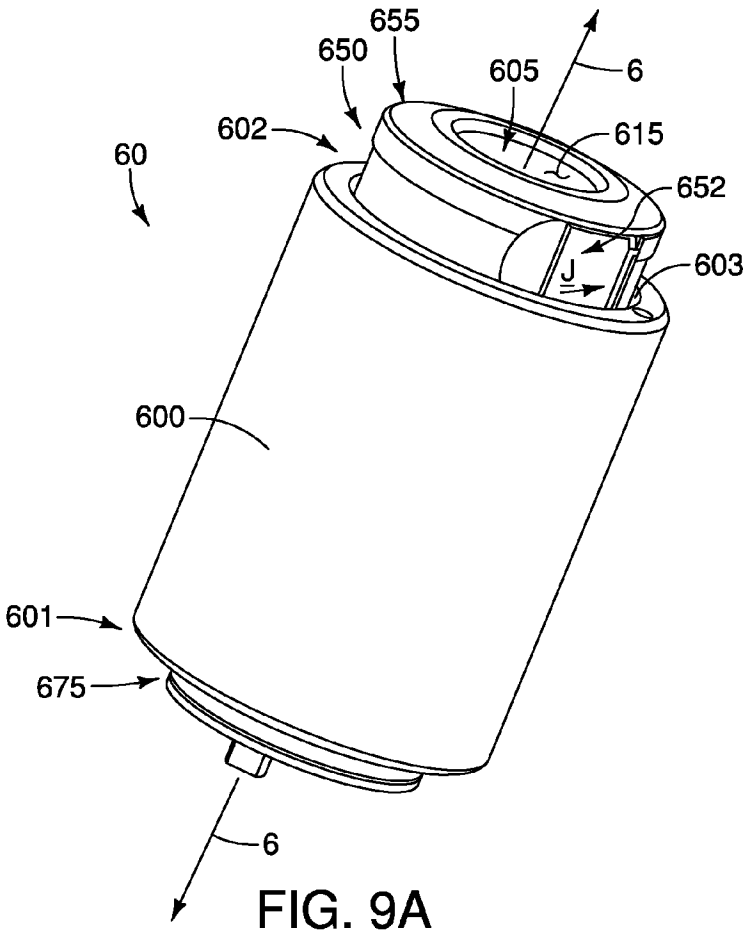
FIG. 9A is a perspective view a spring pack, or driver assembly, according to some embodiments of the present invention, which may be incorporated by punch assemblies of the present invention.

FIG. 9A is a perspective view of a spring pack, or driver assembly 60, according to some embodiments of the present invention, which may be incorporated by punch assemblies of the present invention. FIG. 9A illustrates assembly 60 including a canister sidewall 600, which extends, from a first end 601 to a second end 602 thereof, about a central longitudinal axis 6 of assembly 60, a support member 675, which is coupled to first end 601 of canister sidewall 600, and an adjustment subassembly 650, which is coupled to second end 602 of canister sidewall 600. With reference back to FIGS. 1A-B, assembly 60 may be substituted for assembly 90 such that axis 6 is approximately aligned with axis 1, and a portion of punch holder 15 extends within canister sidewall 600. With further reference to FIG. 1B, in conjunction with FIG. 9A, an end of support member 675 may be inserted into second end 102 of punch guide sidewall 10, for coupling thereto, according to methods known to those skilled in the art, and threaded external surface 154 of punch holder 15 may be engaged with a threaded internal surface 615 of a punch driver, or head 655, which surrounds a longitudinally extending bore 605 of adjustment subassembly 650. Although not shown, those skilled in the art will appreciate that a lifter spring, which extends around punch holder 15, within canister sidewall 600, supports subassembly 650 and rests against an upper surface of support member 675. Thus, during a punching operation, a ram strike applied to punch driver, or head 655 both moves punch holder 15 and punch tip 18, per arrow A (FIG. 1B), and compresses the lifter spring toward support member 675, so that a force of the spring drives a return stroke of punch tip 18.

According to the illustrated embodiment, a rotation of punch head 655, with respect to punch holder 15, via the engagement of threaded surfaces 154, 615, is locked during punching operations, but may be unlocked, via a release member 652 of adjustment subassembly 650. Once unlocked, punch head 655 may be rotated to adjust an axial position of punch holder 15, with respect to head 655, within assembly 60 and punch guide sidewall 10, without having to disassemble any portion of the punch assembly, for example, to accommodate a particular length of punch tip 18. FIG. 9B is an exploded perspective view of adjustment subassembly 650, according to some embodiments, wherein components of subassembly 650, which facilitate this locking and unlocking, may be seen.

FIG. 9B illustrates punch head 655 of adjustment subassembly 650 including a side bore 657 into which a locking member may be fitted, and wherein the locking member is formed by a spherical member 656 and a biasing member 658, for example, a spring, both of which are engaged with a shaft 654, that extends from release member 652. According to the illustrated embodiment, a cut-out portion 619 of an exterior surface 614 of punch head 655 accommodates release member 652, when shaft 654, spherical member 656 and biasing member 658 are fitted within side bore 657, so that an actuation interface 612 of release member 652 is externally accessible. FIG. 9B further illustrates an aperture 659 formed in a sidewall of punch head 655, between side bore 657 and external surface 614, in order to hold spherical member 656 therein, so that spherical member 656 may protrude therefrom to engage within one of a plurality of locking features 653 of an engagement sidewall 613. Locking features 653 are shown as recesses formed in engagement sidewall 613, and engagement sidewall 613 is shown as an inner surface of a retaining ring 651. With reference to FIG. 9A, in conjunction with FIG. 9B, it may be appreciated that, when assembled together, a portion 655' of punch head 655 is inserted within ring 651, and ring 651 fits within an opening 603 at second end 602 of canister sidewall 600 and rests against an end of the lifter spring contained therein.

Figure 9C:
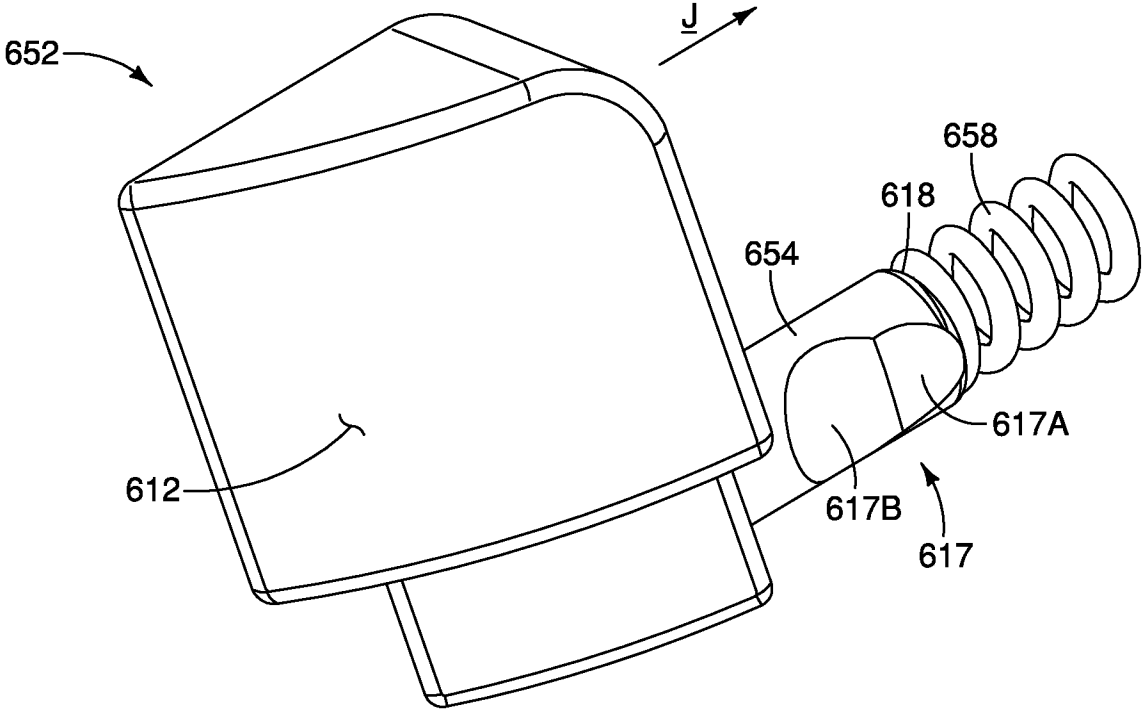
FIG. 9C is a magnified view of a portion of the assembly of FIG. 9A, according to some embodiments.

FIG. 9A further illustrates a direction, per arrow J, in which release member 652 may be pushed in order to move spherical member 656 out of engagement with one of locking features 653; and FIG. 9B illustrates a direction, per arrow K, in which spherical member 656 moves when release member 652 is pushed, per arrow J. The direction of arrow K is shown being inward, toward axis 6, and the direction of arrow J is shown being approximately orthogonal to both axis 6 and the direction of arrow K. Turning now to FIG. 9C, which is a magnified view of release member 652 engaged with biasing member 658, a configuration of shaft 654 of release member 652, which facilitates the movement of spherical member 656, per arrow J, will be described.

FIG. 9C illustrates shaft 654 extending to a terminal end 618, and including a recess 617 formed therein, for engaging spherical member 656 in assembly 650. Referring to FIG. 9C, in conjunction with FIG. 9B, it may be appreciated that biasing member 658 extends from terminal end 618, over a length necessary to butt up against an end wall of bore 657 in subassembly 650, and thereby bias recess 617 with respect to aperture 659 and spherical member 652, which is fitted therein. According to the illustrated embodiment, a first section 617A of recess 617 is shallower than a second section 617B of recess 617 so that, when release member 652 is in a fully biased position, section 617A interfaces with spherical member 652 to hold spherical member 656 in engagement with one of locking features 653. When release member 652 is pushed, per arrow J, as previously described, shaft 654 likewise moves against the biasing of member 658, thereby positioning second section 617B alongside spherical member 656 and aperture 659. It may be appreciated that a greater depth of second section 617B allows spherical member 656 to recede into aperture 659 and out of engagement with the locking feature 653, as punch head 655 is rotated. Thus, in order to adjust an axial position of punch holder 15, with respect to punch head 655, release member 652 is pushed, per arrow J, punch head 655 is rotated about a desired angle, with respect to retaining ring 651, and then release member 652 is released, to allow biasing member 658 to fully bias first section 617A of recess 617 back into contact with spherical member 656, in order to force spherical member 656 into locking engagement with another locking feature 653 of engagement sidewall 613.

With further reference to FIGS. 9A-B, it should be understood that adjustment assembly 650 is slideably engaged within canister sidewall 600 to move along axis 6 in response to a ram strike, but is rotationally locked, as a whole, with respect to canister sidewall 600, via a protruding member 616 of retaining ring 651, that mates with an internal, axially extending, groove (not shown) formed along an inner surface of canister sidewall 600.

Figure 10B:
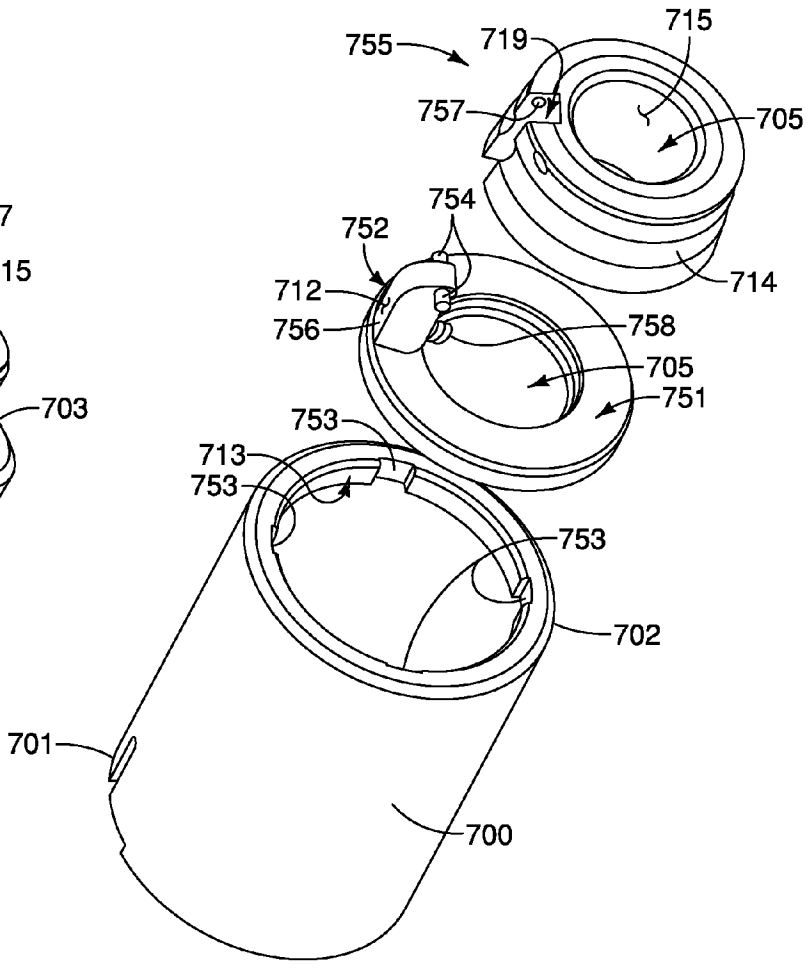
FIG. 10B is an exploded perspective view of a portion of the assembly of FIG. 10A, according to some embodiments.
Figure 10A:
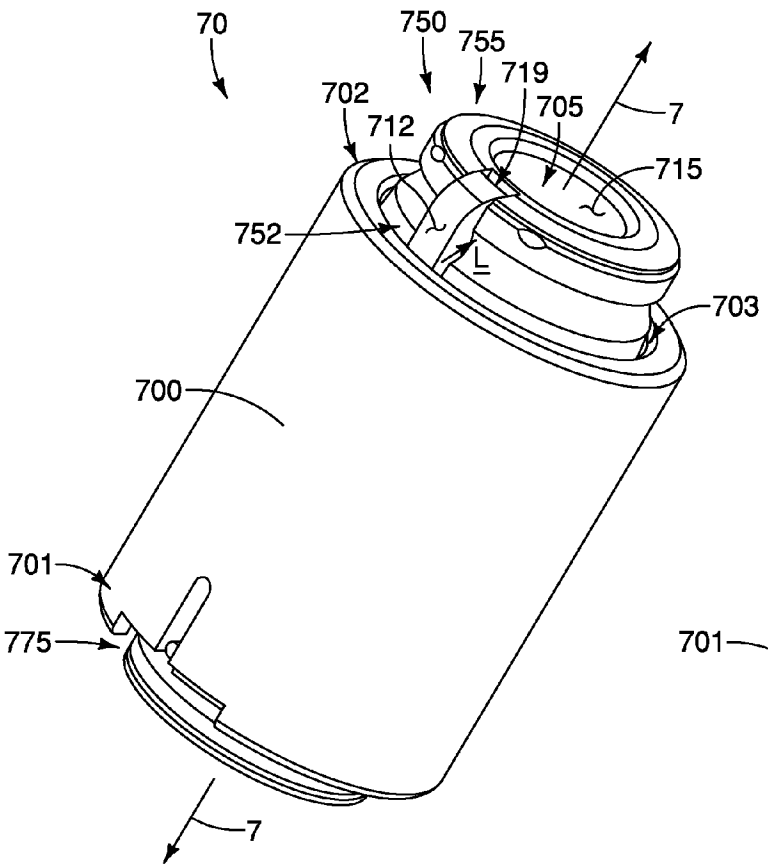
FIG. 10A is a perspective view a spring pack, or driver assembly, according to some additional embodiments of the present invention, which may be incorporated by punch assemblies of the present invention.

FIG. 10A is a perspective view a spring pack, or driver assembly 70, according to some additional embodiments of the present invention, which may be incorporated by punch assemblies of the present invention. FIG. 10A illustrates assembly 70 including a canister sidewall 700, which extends, from a first end 701 to a second end 702 thereof, about a central longitudinal axis 7 of assembly 70, a support member 775, which is coupled to first end 701 of canister sidewall 700, and an adjustment subassembly 750, which is coupled to second end 702 of canister sidewall 700. With reference back to FIGS. 1A-B, assembly 70 may be substituted for assembly 90 such that axis 7 is approximately aligned with axis 1, and a portion of punch holder 15 extends within canister sidewall 700. With further reference to FIG. 1B, in conjunction with FIG. 10A, an end of support member 775 may be inserted into second end 102 of punch guide sidewall 10, for coupling thereto, according to methods known to those skilled in the art, and threaded external surface 154 of punch holder 15 may be engaged with a threaded internal surface 715 of a punch driver, or head 755, which surrounds a longitudinally extending bore 705 of adjustment subassembly 750. Although not shown, those skilled in the art will appreciate that assembly 70 may be fitted with a lifter spring to function in a similar manner to that described, above, for assembly 60.

According to the illustrated embodiment, a rotation of punch head 755, with respect to punch holder 15, via the engagement of threaded surfaces 154, 715, is locked during punching operations, but may be unlocked, via a release member 752 of adjustment subassembly 750. Once unlocked, punch head 755 may be rotated to adjust an axial position of punch holder 15, with respect to head 755, within assembly 70 and punch guide sidewall 10, without having to disassemble any portion of the punch assembly, for example, to accommodate a particular length of punch tip 18. FIG. 10B is an exploded perspective view of adjustment subassembly 750, according to some embodiments, wherein features of subassembly 750, which facilitate this locking and unlocking, may be seen.

FIG. 10B illustrates punch head 755 of adjustment subassembly 750 including an exterior surface 714 that has a cut-out portion 719 for receiving release member 752; sidewalls of cut-out portion 719 include side bores 757 to receive a pivot pin 754 of release member 752 for pivotable attachment of release member 752 to punch head, such that an actuation interface 712 of release member 752 is externally accessible. A locking member 756 is shown integrally formed with release member 752, as an extension of actuation interface 712, and a biasing member 758, for example, a spring, is shown coupled to release member 752, opposite locking member 756, in order to bias locking member 756, with respect to cut-out portion 719 of punch head 755. FIG. 10B further illustrates adjustment subassembly 750 including a retaining ring 751 and an engagement sidewall 713; engagement sidewall 713 is formed by an internal surface of canister sidewall 700, at second end 702 thereof, and includes a plurality of grooves which form locking features 753 sized to mate with the biased locking member 756.

With reference to FIG. 10B, in conjunction with FIG. 10A, it may be appreciated that, when ring 751 and punch head 755 are fitted, together, within an opening 703 at second end 702 of canister sidewall 700, both surround longitudinally extending bore 705 of adjustment subassembly 750, and ring 751 is positioned, just below engagement sidewall 713, to rest against an end of the lifter spring, which is contained within sidewall 700. According to the illustrated embodiment, the biased locking member 756 fits within each of locking features 753, in order to lock relative rotation between punch head 755 and punch holder 15, until an inward push force, per arrow L (FIG. 10A) is applied to the externally accessible actuation interface 712 of release member 752, in order to move locking member 756 against the biasing force of member 758 and out of engagement with one of locking features 753. Thus, when, for example, a finger of a hand pushes actuation interface 712 inward, toward longitudinal axis 7, the hand may rotate punch head 755 and thereby adjust an axial position of punch holder 15.

Adjusting the position of punch holder 15, by means of each of the above-described adjustment subassemblies 650 and 750, are facilitated by release members 652 and 752, respectively, which are actuated in order to unlock the corresponding punch head 655, 755 for subsequent rotation. Yet, according to some other methods of the present invention, a rotation of a release member is preferred for unlocking the punch head. According to some alternate embodiments, for example, as will be presented below, an externally accessible actuation interface of the release member may be grasped to initially rotate the release member, and thereby unlock punch head; once the punch head is unlocked, further rotation of the release member also rotates the punch head for the positional adjustment of the punch holder, or punch body, of the punch tool assembly. As is the case for the above-described assemblies, those which will be described below do not require that any portion thereof be disassembled in order to unlock the punch head or to make the subsequent adjustment. Furthermore, according to preferred methods, any of the embodiments of adjustment assemblies, described herein, may be operated by hand without the need for a special tool.

Figure 11B:
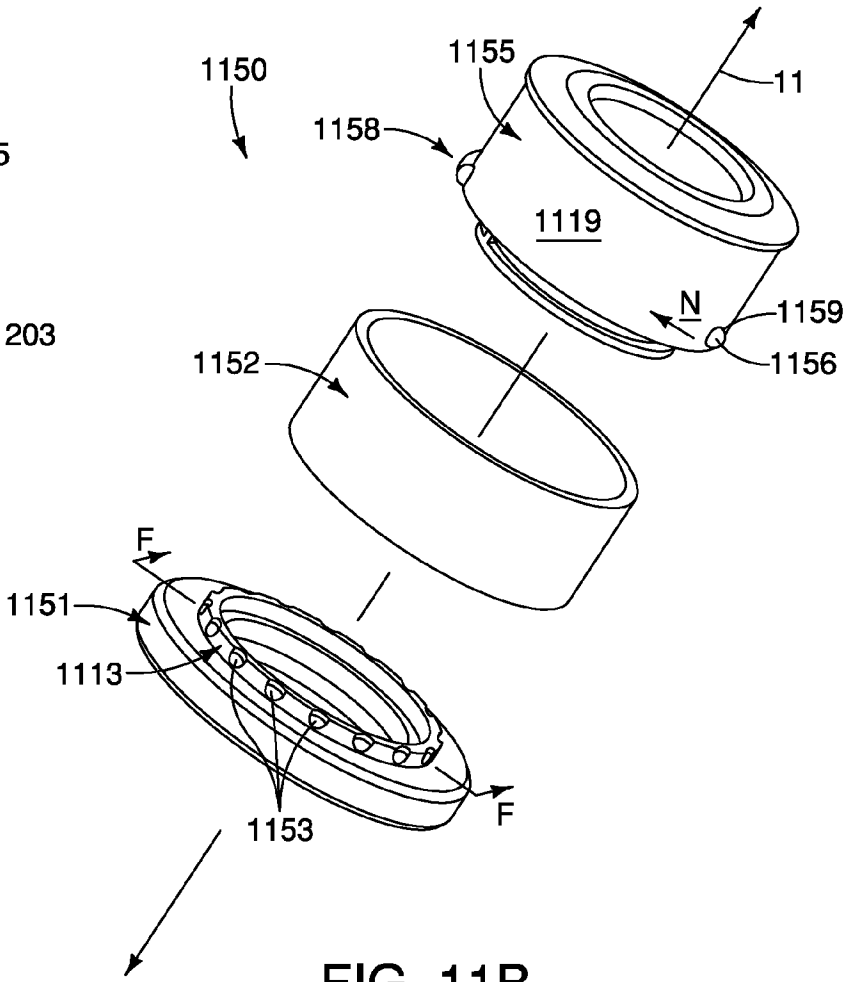
FIG. 11B is an exploded perspective view of a portion of the assembly shown in FIG. 11A, according to some embodiments.
Figure 11A:
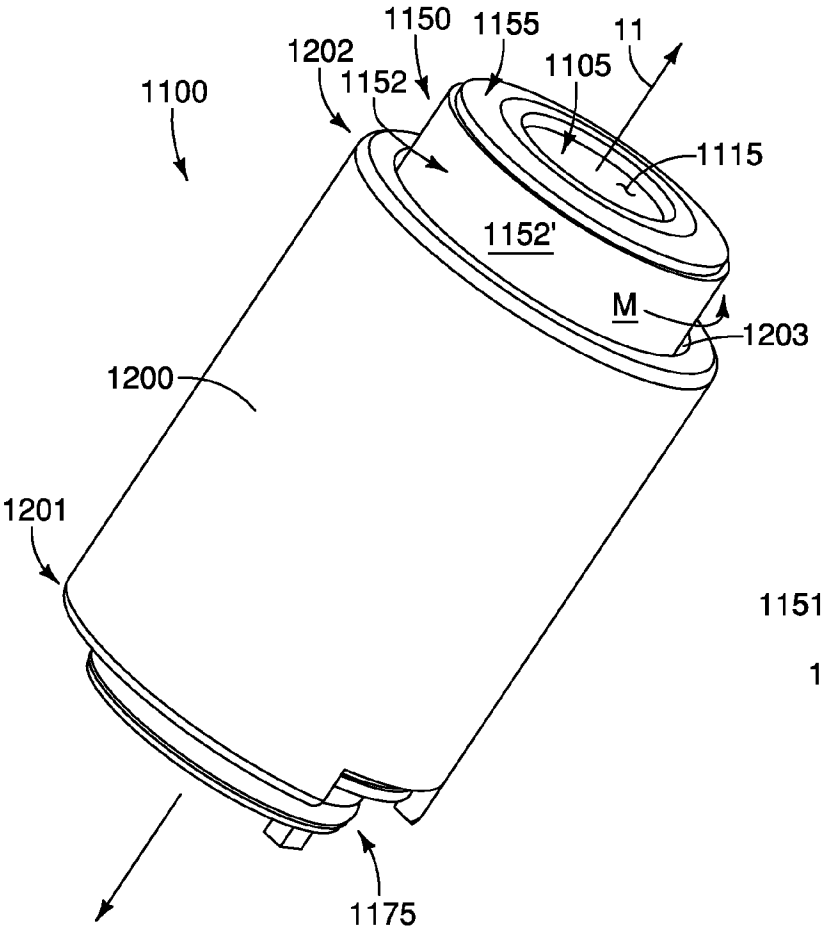
FIG. 11A is a perspective view of a spring pack, or driver assembly, according to some other embodiments of the present invention.

FIG. 11A is a perspective view of a spring pack assembly 1100, according to some other embodiments of the present invention, which may be incorporated by punch assemblies of the present invention. FIG. 11A illustrates assembly 1100 including a canister sidewall 1200, which extends, from a first end 1201 to a second end 1202 thereof, about a central longitudinal axis 11 of assembly 1100, a support member 1175, which is coupled to first end 1201 of canister sidewall 1200, and an adjustment subassembly 1150, which is coupled to second end 1202 of canister sidewall 1200. With reference back to FIGS. 1A-B, assembly 1100 may be substituted for assembly 90 such that axis 11 is approximately aligned with axis 1, and a portion of punch holder 15 extends within canister sidewall 1200. With further reference to FIG. 1B, in conjunction with FIG. 11A, an end of support member 1175 may be inserted into second end 102 of punch guide sidewall 10, for coupling thereto, according to methods known to those skilled in the art, and threaded external surface 154 of punch holder 15 may be engaged with a threaded internal surface 1115 of a punch driver, or head 1155 of adjustment subassembly 1150, which surrounds a longitudinally extending bore 1105 of adjustment subassembly 1150. Although not shown, those skilled in the art will appreciate that assembly 1100 may be fitted with a lifter spring to function in a similar manner to that described, above, for assembly 60.

FIG. 11A further illustrates adjustment subassembly 1150 including a release member 1152, which has an external actuation interface 1152'. According to the illustrated embodiment, a force, which is applied to actuation interface 1152' to rotate release member 1152, per arrow M, unlocks punch head 1155 for rotation with respect to a punch body, or holder, for example, holder 15 (FIG. 1B); this rotation causes the punch body, or holder, to move in an axial direction, via a threaded engagement, for example, as described above between head 1155 and holder 15. Thus an axial position of the punch body, or holder, within assembly 1100, may be adjusted by rotating release member 1152, per arrow M, without having to disassemble any portion of the punch assembly. As will be seen, below, in FIGS. 11C-D, release member 1152 is configured to accommodate rotation in an opposite direction, to that indicated by arrow M, in order to unlock punch head 1155, for adjustment, in the opposite direction. The rotation of punch head 1155 is locked, by a locking member of subassembly 1150, when the aforementioned force is not applied to actuation interface 1152'. FIG. 11B is an exploded perspective view of adjustment subassembly 1150, according to some embodiments, wherein components of subassembly 1150, which facilitate locking, and unlocking, may be seen.

Figure 11D:
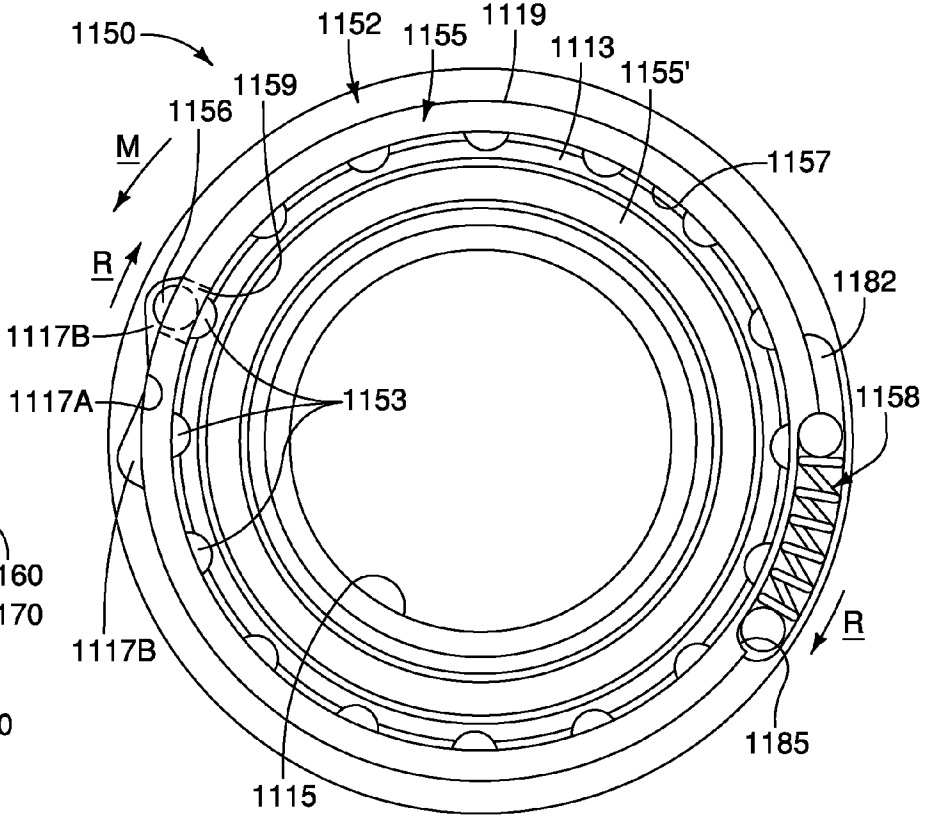
FIG. 11D is a radial cross-section view of the portion of the assembly, per section line F-F of FIG. 11B.
Figure 11C:
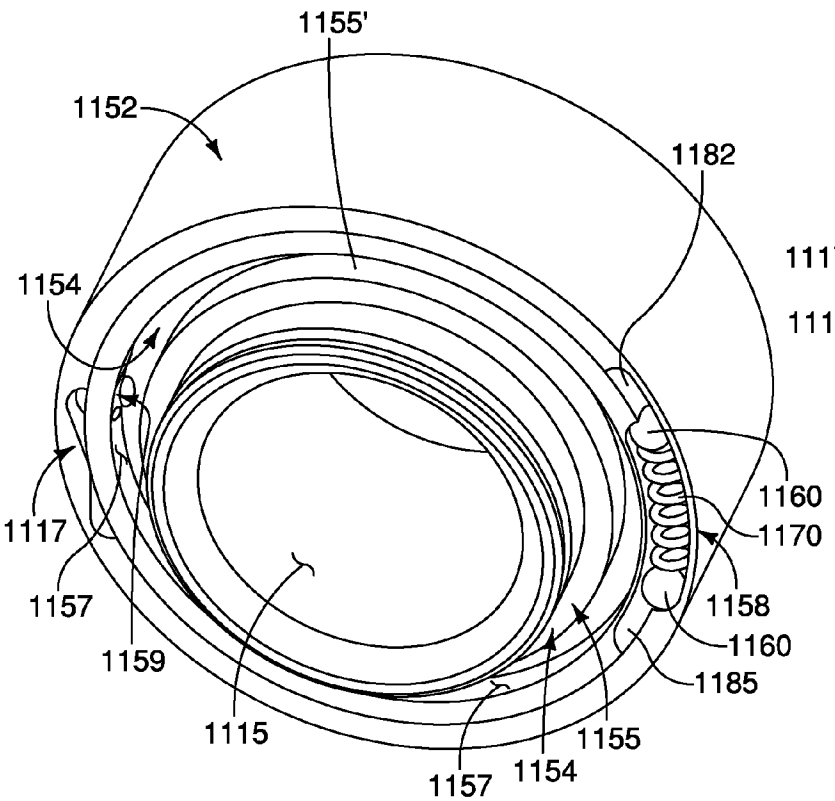
FIG. 11C is an alternate perspective view of a portion of the portion of the assembly shown in FIG. 11B.

FIG. 11B illustrates the locking member of adjustment subassembly 1150 being formed by a spherical member 1156, mounted within a radial bore 1159 of punch head 1155, for engagement with a retaining ring 1151 of subassembly 1150; retaining ring 1151 is shown including an engagement sidewall 1113, in which a plurality of locking features 1153, for example, recesses, are formed. With reference to FIG. 11C, which is an alternate perspective view of a portion of adjustment subassembly 1150, it may be seen that punch head 1155 includes an inner surface 1157 that surrounds, and is spaced apart from, an inner portion 1155' of punch head 1155 to form an annular space 1154. According to the illustrated embodiment, annular space 1154 receives engagement sidewall 1113 of retaining ring 1151, in subassembly 1150, such that a radial bore 1159, which extends from an external surface 1119 of punch head 1155 to internal surface 1157, is axially aligned with locking features 1153 of sidewall 1113. FIG. 11D, which is a radial cross-section view through adjustment subassembly 1150, per section line F-F of FIG. 11B, shows spherical member 1156 positioned for engagement with one of locking features 1153 of sidewall 1113. FIGS. 11C-D further illustrate release member 1152 being formed as a ring that extends about outer surface 1119 of punch head 1155; release member 1152 includes internal lock and release features 1117, which are located in proximity to radial bore 1159 of punch head 1155. Internal lock and release features 1117, of release member 1152, are shown including an internal holding surface 1117A and adjacent internal recesses 1117B, which are located on either side of holding surface 1117A.

According to the illustrated embodiment, when holding surface 1117A is aligned with spherical member 1156, surface 1117A forces member 1156 to protrude from inner surface 1157 of punch head 1155 and engage with one of locking features 1153, in order to lock rotation of punch head 1155; the alignment of holding surface 1117A and spherical member 1156 is biased by a biasing member 1158 of subassembly 1150, which will be described below. FIG. 11D illustrates release member 1152 having been rotated per arrow M in order to align one of recesses 1117B with spherical member 1156 and, thereby, allow member 1156 to move out of engagement with one of locking features 1153, in order to unlock punch head 1155 from sidewall 1113. With reference to FIG. 11D, it may be appreciated that further rotation of release member 1152, per arrow M, will cause punch head 1155 to rotate about axis 11 (FIGS. 11A-B), via an interlocking of spherical member 1156 with recess 1117B of release member 1152 and radial bore 1159 of punch head 1155. As mentioned above, it can be seen that release member 1152 may be rotated in the direction opposite to that of arrow M, to align spherical member 1156 with the other of recesses 1117B and, thereby, unlock punch head 1155 for adjustment in the opposite direction. The rotation of punch head 1155 will move a punch body, or punch holder (not shown), along axis 11, via the threaded engagement of threaded internal surface 1115 of punch head 1155 with a mating threaded surface of the punch body, or holder, for example, surface 154 of holder 15 (FIG. 1B). Thus, an adjustment in the axial position of the punch body, or holder, is made.

FIGS. 11C-D illustrate biasing member 1158 of adjustment subassembly 1150, which is engaged within both an external cavity 1185 of punch head 1155 and an internal cavity 1182 of release member 1152, including a spring element 1170 held between a pair of spherical elements 1160. In FIGS. 11C-D, biasing member 1158 is shown compressed by opposing ends of cavities 1185, 1182, which are displaced from alignment with one another upon initial rotation of release member 1152, per arrow M. With reference to FIG. 11D, it may be appreciated that, biasing member 1158 will remain compressed as long as a force continues to rotate release member 1152, per arrow M, in order to make the above described adjustment, but, once the force is released, biasing member 1158, by virtue of the force of spring element 1170, will expand and, thereby, force an opposite rotation, per arrow R, of release member 1152. This rotation, per arrow R, will re-align cavities 1185, 1182, with one another, and holding surface 1117A, with spherical member 1156; the latter re-alignment of holding surface 1117A forces spherical member 1156 to move, per arrow N, back into engagement with one of locking features 1153 of engagement sidewall 1113, thereby locking rotation of punch head 1155, as described above.

Figure 12B:
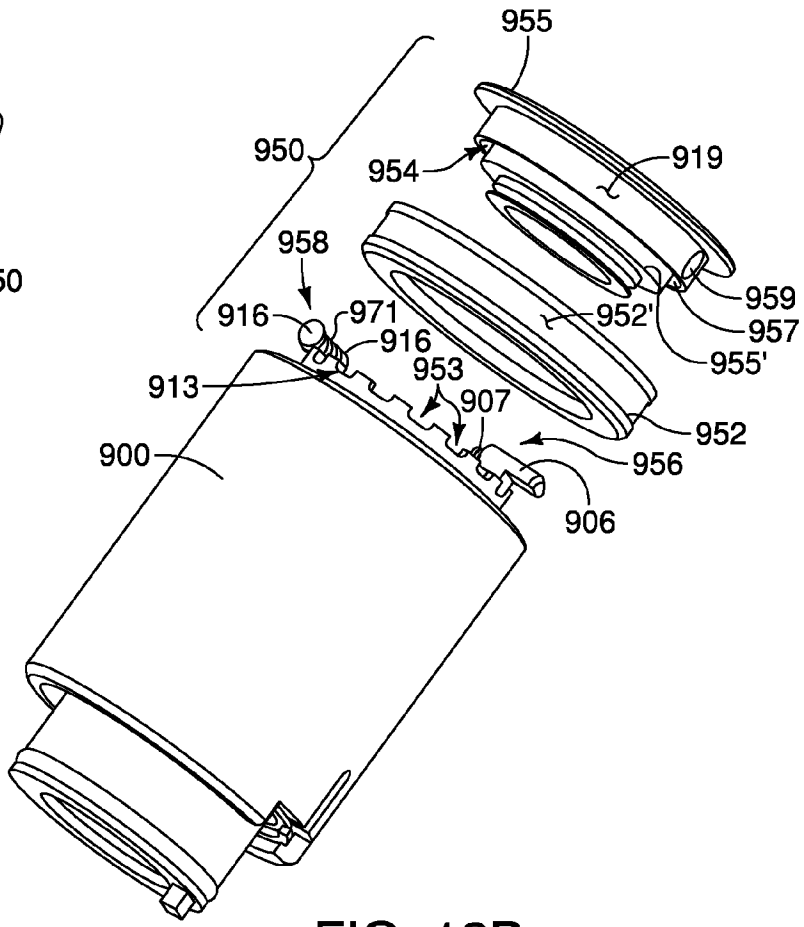
FIGS. 12A-B are exploded perspective views of a spring pack, or driver assembly, which is shown incorporated in the punch assembly of FIG. 1A, according to yet further embodiments of the present invention.
Figure 12A:
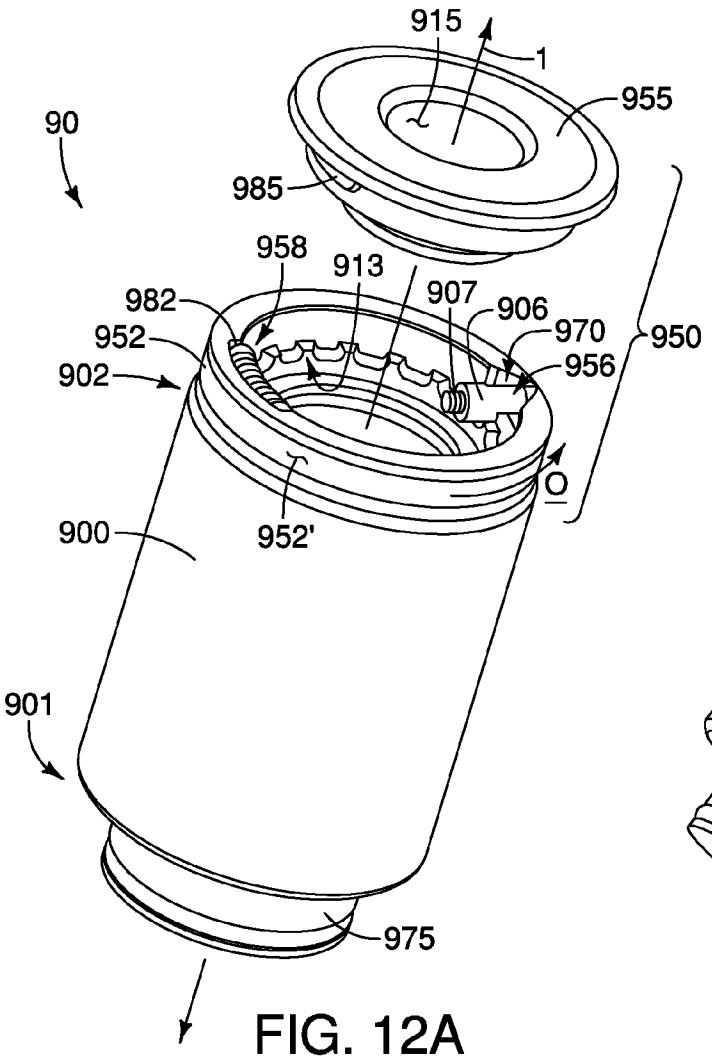

FIGS. 12A-B are exploded perspective views of spring pack assembly 90, being separated from punch assembly 100 of FIG. 1A, according to yet further embodiments of the present invention. FIGS. 1A and 12A-B illustrated assembly 90 including a canister sidewall 900, which extends from a first end 901 to a second end 902 thereof, about central longitudinal axis 1, a support member 975, which is coupled to first end 901 of canister sidewall 900, and an adjustment subassembly 950, which is coupled to second end 902 of canister sidewall 900. With further reference to FIGS. 12A-B, in conjunction with FIGS. 1A-B, an end of support member 975 is adapted for insertion into second end 102 of punch guide sidewall 10, for coupling thereto, according to methods known to those skilled in the art, and threaded external surface 154 of punch holder 15 is adapted to engage with a threaded internal surface 915, of a punch head 955 of adjustment subassembly 950. Although not shown, those skilled in the art will appreciate that assembly 90 may be fitted with a lifter spring to function in a similar manner to that described, above, for spring pack assembly 60. FIGS. 1A and 12A further illustrate adjustment subassembly 950 including a release member 952, which has an external actuation interface 952'. According to the illustrated embodiment, a force, which is applied to actuation interface 952' to rotate release member 952, per arrow O, unlocks punch head 955 for rotation with respect to punch holder 15 (FIG. 1B); this rotation causes punch holder 15 to move in an axial direction, via the above-described threaded engagement between head 955 and holder 15. Thus, an axial position of punch holder 15, within assembly 90, may be adjusted by rotating release member 952, per arrow O, without having to disassemble any portion of punch assembly 100. The rotation of punch head 955 is locked by a locking member 956 of adjustment subassembly 950, when the aforementioned force is not applied to actuation interface 952'.

FIGS. 12A-B illustrate locking member 956 including a pin 906 and a spring 907, and punch head 955 including a radial bore 959, which extends from an external surface 919 of punch head 955 to an internal surface 957 of punch head 955, and continues into an inner portion 955' of punch head 955. According to the illustrated embodiment, when spring pack assembly 90 is assembled, spring 907 and pin 906 are mounted within radial bore 959 of punch head 955, such that spring 907 is located within that part of bore 959 that extends within inner portion 955'; spring 907 biases pin 906, in a first, locked position, with respect to punch head 955, so as to be engaged within one of a plurality of locking features 953 of an engagement sidewall 913, which are formed as slots extending through sidewall 913. With reference to FIG. 12B, it may be seen that internal surface 957 surrounds and is spaced apart from inner portion 955' to form an annular space 954, for the insertion of engagement sidewall 913 of subassembly 950 therein; engagement sidewall 913 is shown as an integral extension of canister sidewall 900, but can be formed as a separate element, according to alternate embodiments. FIG. 12A further illustrates release member 952 surrounding engagement sidewall 913 and being located in subassembly 950 to also surround external surface 919 of punch head 955, when engagement sidewall 913 is inserted within annular space 954 of punch head 955, such that an internal lock and release feature 970 of release member 952 interfaces with pin 906; internal lock and release feature 970 moves pin 906 from the first, locked position to a second, unlocked position, with respect to punch head 955, when release member 952 is rotated, for example, per arrow O. Internal lock and release feature 970 will be described in greater detail, below, in conjunction with FIGS. 12D-E. It should be noted that FIGS. 12A-B show pin 906 in the first, locked position.

Figure 12C:
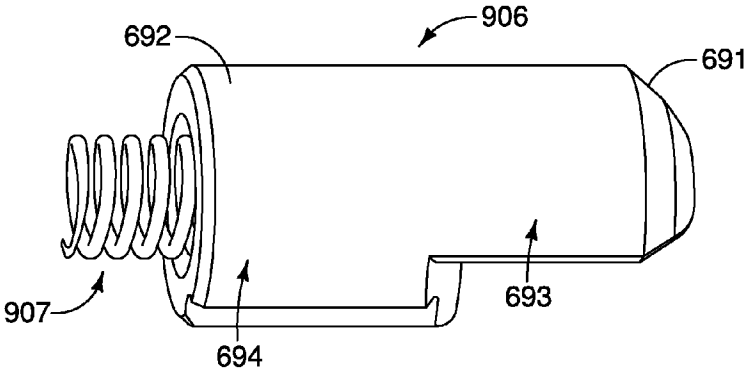
FIG. 12C is a perspective view of a portion of a subassembly of the spring pack assembly shown in FIGS. 12A-B.
Figure 12E:
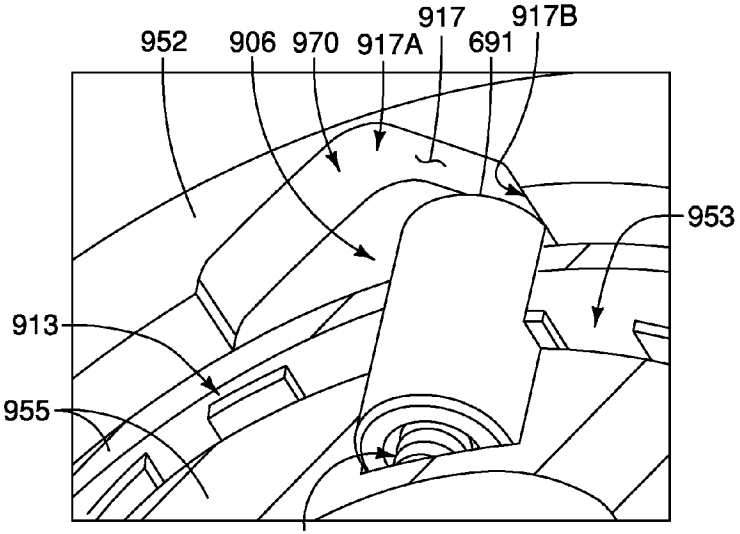
FIGS. 12D-E are enlarged detailed views, including cutaway sections, of the subassembly of the spring pack assembly shown in FIGS. 12A-B.
Figure 12D:
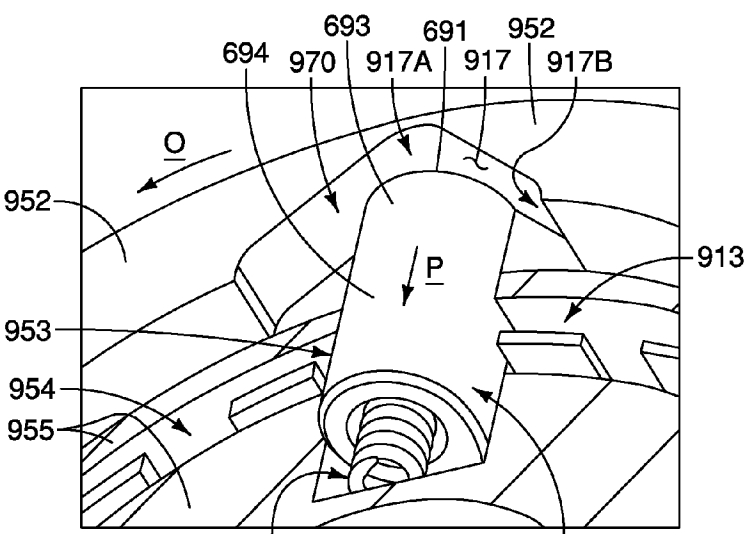

FIG. 12C is an enlarged perspective view of locking member 956, separated from the rest of subassembly 950, according to some embodiments. FIG. 12C illustrates pin 906 including a first, outer end 691 and a second, inner end 692, which spring 907 engages; a locking portion 694 of pin 906 is shown extending from inner end 692 toward outer end 691, such that spring 907 biases locking portion 694 for engagement in one of locking features 953, as is shown in FIG. 12D. FIG. 12C further illustrates pin including a release portion 693, which extends between locking portion 694 and first, outer end 691, and has a smaller profile than locking portion 694. According to the illustrated embodiment, when release member 952 is rotated to move pin 906 against the bias of spring 907, locking portion 694 moves out of radial alignment with engagement sidewall 913, and release portion 693 of pin 906 becomes radially aligned with sidewall 913, as is shown in FIG. 12E. When locking portion 694 of pin 906 is in radial alignment with engagement sidewall 913, pin 906 is engaged with one of locking features 953, but, when release portion 693 of pin 906 is radially aligned with engagement sidewall 913, pin 906 is not engaged with one of locking features 953, due to the aforementioned smaller profile of release portion 693. Thus, initial rotation of release member 952 unlocks punch head 955 for further rotation and resulting axial movement of punch holder 15.

FIGS. 12D-E are enlarged detailed views, including cutaway radial sections through punch head 955. FIGS. 12D-E illustrates internal lock and release feature 970 of release member 952 including a camming surface 917 having a first end 917A and a second end 917B. FIG. 12D illustrates pin 906 biased in the first, locked position with respect to punch head 955, such that outer end 691 of pin 906 is positioned at first end 917A of camming surface 917; in this position, it can be seen that locking portion 694 of pin 906 is engaged within locking feature 953 of engagement sidewall 913. FIG. 12E illustrates outer end 691 of pin 906 located at second end 917B of camming surface 917 so that locking portion 694 of pin 906 is disengaged from locking feature 953. According to the illustrated embodiment, when release member 952 is moved, per arrow O (FIG. 12D), camming surface 917 of release feature 970 forces pin 906 axially inward, per arrow P (FIG. 12D), against the bias of spring 907, and, once in this second, unlocked position, pin 906, via the smaller profile of release portion 693, clears engagement sidewall 913, thereby allowing punch head 955 to be rotated further by the rotation of release member 952.

With reference back to FIGS. 12A-B, adjustment subassembly 950 preferably further includes a biasing member 958, which is engaged within both an external cavity 985 of punch head 955 and an internal cavity 982 of release member 952, similar to biasing member 1158 of subassembly 1150 described in conjunction with FIGS. 11C-D. Like biasing member 1158, biasing member 958, includes a spring element 971 held between a pair of spherical elements 916, such that when release member is rotated, per arrow O, biasing member 958 is compressed by the displacement of cavities 985 and 982. According to the illustrated embodiment, biasing member 958 will remain compressed as long as a force continues to rotate release member 952, per arrow O, in order to make the above described adjustment, but, once the force is released, biasing member 958, by virtue of the force of spring element 971, will expand and, thereby, force an opposite rotation, in order to re-align cavities 985, 982, with one another, so that pin 906 is moved back into engagement with one of locking features 953 of engagement sidewall 913, thereby locking rotation of punch head 955, as described above.

In the foregoing detailed description, the invention has been described with reference to specific embodiments. However, it may be appreciated that various modifications and changes can be made without departing from the scope of the invention as set forth in the appended claims. It should be noted that the terms "punch driver" and "punch head" are used interchangeably in the context of the present disclosure. Also, the term "member", as used herein, may denote either a single component or a sub-assembly, that includes multiple components.

We claim:

1. A spring pack assembly for a punch tool, the assembly comprising:

a canister including a first end, adapted for coupling to a punch guide sidewall, and a second end, adapted for receiving a ram strike in proximity thereto; and an adjustment subassembly being coupled to the canister yet spaced away from the first end of the canister, the adjustment subassembly comprising a punch head, an engagement sidewall, a locking member, and a release member;

wherein the punch head is adapted to engage either a punch body or a punch holder, such that, when the punch body/holder extends within the canister and is mated with the punch head, a rotation of the punch head will move the punch body/holder along a central longitudinal axis of the canister;

the engagement sidewall surrounds a portion of the punch head;

the locking member, in a first position, is engaged with the engagement sidewall, so as to prevent the rotation of the punch head; and the release member includes an externally accessible actuation interface movable in a spiral direction about the central longitudinal axis such that a single force applied to the interface in the spiral direction results in release of the locking member from the engagement sidewall and rotation of the punch head.

2. The assembly of claim 1, wherein the force, received by the actuation interface of the release member, moves the locking member, from the first position to the second position, in an inward, radial direction, toward the central longitudinal axis.

3. The assembly of claim 1, wherein the force, received by the actuation interface of the release member, is applied in a direction curving about the central longitudinal axis of the canister, and wherein the force correspondingly moves the locking member from the first position to the second position.

4. The assembly of claim 3, wherein when the locking member is in the second position, the locking member is released from engagement with the engagement sidewall so as to allow the rotation of the punch head via continued application of the force on the actuation interface about the central longitudinal axis of the spring pack assembly.

5. The assembly of claim 1, wherein the adjustment subassembly further comprises a biasing member engaged between the punch head and the release member, the biasing member applying a biasing force that opposes the force received by the actuation interface for moving the locking member from the first position to the second position.

6. The assembly of claim 5, wherein:

the punch head further includes an external cavity;

the release member further includes an internal cavity; and the internal cavity of the release member and the external cavity of the punch head, together contain the biasing member, such that a rotation of the release member with respect to the punch head compresses the biasing member against the biasing force thereof.

7. The assembly of claim 1, wherein:

the release member is configured to move in a first direction via application of the force on the actuation interface which results in movement of the locking member in a second direction; and wherein the second direction is inward, toward the central longitudinal axis;

and the first direction extends circumferentially about the central longitudinal axis.

8. The assembly of claim 1, wherein the force received by the actuation interface of the release member is directed inward, toward the central longitudinal axis, for moving the locking member inward, toward the central longitudinal axis, from the first position to the second position.

9. The assembly of claim 8, wherein the locking member is integrally formed with the release member, being an extension of the actuation interface.

10. The assembly of claim 1, wherein the engagement sidewall includes a plurality of locking features spaced apart, from one another, about a circumference of the engagement sidewall, each of the locking features being sized to engage the locking member.

11. The assembly of claim 10, wherein the plurality of locking features of engagement sidewall comprises a plurality of slots extending through the engagement sidewall.

12. The assembly of claim 10, wherein the engagement sidewall is integrally formed with the second end of the canister.

13. The assembly of claim 12, wherein the plurality of locking features of engagement sidewall comprises a plurality of grooves formed in an internal surface of the second end of the canister sidewall.

14. The assembly of claim 10, wherein:

the release member comprises a ring, the ring surrounding the engagement sidewall and including an external surface and at least one internal lock and release feature;

the external surface of the ring forms the externally accessible actuation interface of the release member;

the at least one internal lock and release feature of the release member engages the locking member; and the force, received by the actuation interface of the release member, rotates the release member to move the at least one internal lock and release feature and thereby cause the locking member to move from the first position to the second position.

15. The assembly of claim 14, wherein:

the punch head further includes a radial bore extending from an external surface of the punch head to an inner surface of the punch head;

the release member further surrounds the external surface of the punch head;

the at least one internal lock and release feature of the release member is approximately aligned with the radial bore of the punch head;

the plurality of locking features of the engagement sidewall comprises a plurality of recesses facing outward from the central longitudinal axis; and the locking member comprises a spherical member, the spherical member mounted within the radial bore of the punch head.

16. The assembly of claim 10, wherein:

the engagement sidewall comprises an inner surface of a retaining ring coupled to the second end of the canister; and the plurality of locking features comprises a plurality of recesses formed in the inner surface of the retaining ring.

17. The assembly of claim 10, wherein:

the engagement sidewall comprises an outer surface of a retaining ring coupled to the second end of the canister sidewall; and the plurality of locking features comprises a plurality of recesses formed in the outer surface of the retaining ring.

18. A spring pack assembly for a punch tool, the assembly comprising:

a canister; and an adjustment subassembly being coupled to the canister and comprising a punch head, an engagement sidewall, a locking member and a release member;

wherein the punch head is adapted to engage either a punch body or a punch holder, such that, when the punch body/holder is mated with the punch head, a rotation of the punch head will move the punch body/holder along a central longitudinal axis of the canister;

the engagement sidewall surrounds a portion of the punch head;

the locking member, in a first position, is engaged with the engagement sidewall, so as to prevent the rotation of the punch head; and the release member includes an externally accessible actuation interface movable in a spiral direction about the central longitudinal axis such that a single force applied to the interface in the spiral direction results in release of the locking member from the engagement sidewall and rotation of the punch head.

19. The assembly of claim 18, wherein the engagement sidewall is integrally formed with the second end of the canister sidewall.

20. The assembly of claim 18, wherein:

the release member comprises a ring, the ring surrounding the engagement sidewall and including an outer surface and at least one internal lock and release feature;

the outer surface of the ring forms the externally accessible actuation interface of the release member;

the at least one internal lock and release feature of the release member engages the locking member; and the force, received by the actuation interface of the release member, moves the at least one internal lock and release feature and, thereby, causes the locking member to move from the first position to the second position.

21. The assembly of claim 18, wherein:

the release member comprises a ring surrounding the punch head; and the adjustment subassembly further comprises a biasing member engaged between the punch head and the release member, the biasing member applying a biasing force that opposes the force received by the actuation interface for moving the locking member from the first position to the second position.

22. The assembly of claim 21, wherein:

the punch head further includes an external cavity;

the release member further includes an internal cavity; and the internal cavity of the release member and the external cavity of the punch head, together contain the biasing member, such that a rotation of the release member with respect to the punch head compresses the biasing member against the biasing force thereof.

23. The assembly of claim 18, wherein:

the punch head further includes a radial bore, the radial bore extending into the portion of the punch head, which the engagement sidewall surrounds;

the release member comprises a ring, the ring including at least one internal lock and release feature, the at least one internal lock and release feature being approximately aligned with the radial bore of the punch head;

the locking member comprises a pin and a spring, the pin including a first, outer end and a second, inner end, and the spring engaging the second inner end of the pin, the pin being mounted in the radial bore of the punch head, such that the spring and the second, inner end of the pin are enclosed in the radial bore, and the first, outer end of the pin protrudes from the radial bore and into the at least one internal lock and release feature; and the at least one internal lock and release feature includes at least one camming surface for contacting the first, outer end of the pin, in order to move the locking member from the first position to the second position.

24. The assembly of claim 18, wherein the force, received by the actuation interface of the release member, is applied in a direction curving about the central longitudinal axis of the spring pack assembly, and wherein the force correspondingly moves the locking member from the first position to the second position.

25. The assembly of claim 18, wherein the engagement sidewall includes a plurality of locking features spaced apart, from one another, about a circumference of the engagement sidewall, each of the locking features being sized to engage the locking member.

26. The assembly of claim 25, wherein the plurality of locking features of engagement sidewall comprises a plurality of slots extending through the engagement sidewall.

27. The assembly of claim 25, wherein:

the engagement sidewall comprises an outer surface of a retaining ring coupled to the second end of the canister sidewall; and the plurality of locking features comprises a plurality of recesses formed in the outer surface of the retaining ring.

28. The assembly of claim 25, wherein:

the punch head further includes a radial bore extending from an external surface of the punch head to an inner surface of the punch head;

the release member comprises a ring, the ring surrounding the external surface of the punch head and including at least one internal lock and release feature, the at least one internal lock and release feature being approximately aligned with the radial bore of the punch head;

the plurality of locking features of the engagement sidewall comprises a plurality of recesses facing outward from the central longitudinal axis; and the locking member comprises a spherical member, the spherical member mounted within the radial bore of the punch head.

29. The assembly of claim 18, wherein one end of the canister is adapted for receiving a ram strike in proximity thereto, the adjustment subassembly being spaced from an opposing end of the canister.

* * * * *